US006758716B1

(12) United States Patent
Rehkemper et al.

(10) Patent No.: US 6,758,716 B1
(45) Date of Patent: Jul. 6, 2004

(54) ELECTRONIC TOY WITH A POINT OF SALE DEMONSTRATION

(75) Inventors: Steven Rehkemper, Chicago, IL (US); Michael Kass, Willowbrook, IL (US); Jackson Wilson, Chicago, IL (US)

(73) Assignee: Rehco, L.L.C., Chicago, IL (US)

( * ) Notice: Subject to any disclaimer, the term of this patent is extended or adjusted under 35 U.S.C. 154(b) by 0 days.

(21) Appl. No.: 10/379,936

(22) Filed: Mar. 6, 2003

Related U.S. Application Data

(62) Division of application No. 10/026,333, filed on Dec. 21, 2001, now Pat. No. 6,652,351.

(51) Int. Cl.[7] ..... A63H 3/28
(52) U.S. Cl. ..... 446/297; 446/302; 446/397
(58) Field of Search ..... 446/297, 298, 446/299, 302, 247, 251, 252, 450, 454, 456, 471, 409, 411, 397, 441

(56) References Cited

U.S. PATENT DOCUMENTS 4,272,915 A * 6/1981 Noble ..... 446/298
4,828,525 A * 5/1989 Okano ..... 446/175
4,846,693 A * 7/1989 Baer ..... 434/308
5,024,626 A * 6/1991 Robbins et al. ..... 446/409
5,046,981 A * 9/1991 Roddy ..... 446/81
5,636,994 A * 6/1997 Tong ..... 434/308
5,746,602 A * 5/1998 Kikinis ..... 434/169
6,273,782 B1 * 8/2001 Chan et al. ..... 446/356
6,290,566 B1 * 9/2001 Gabai et al. ..... 446/175
6,319,010 B1 * 11/2001 Kikinis ..... 434/169
6,343,970 B1 * 2/2002 Lee et al. ..... 446/330

* cited by examiner

*Primary Examiner*—Jacob K. Aclain
*Assistant Examiner*—Bena B. Miller

(57) ABSTRACT

In accordance with the present invention, there is provided a dancing figure that includes a body defined by a torso, a head, and a pair of arms, and a pair of legs pivotally attached to the torso at a hip region. Each leg includes at least an upper leg section pivotally attached to a lower leg section at a knee region. Also included therewith is a pair of oversized feet adapted to provide support such that the figure is free-standing. The pair of oversized feet is separately and pivotally attached to one of the lower leg sections at an ankle region. Each foot houses a foot mechanism for independently pivoting the lower leg sections forwards and backwards at said ankle region, wherein the pivoting at said ankle regions causes pivoting motion at the knee regions and hip region to simulate animated movement in the figure. In addition thereto the foot mechanism may independently twist the foot to the left and right.

5 Claims, 25 Drawing Sheets

ELECTRONIC TOY WITH A POINT OF SALE DEMONSTRATION

FIELD OF THE INVENTION

This invention relates generally to animated toys and more particularly to dolls and figures that are mechanically animated to simulate movements.

BACKGROUND OF THE INVENTION

Toy dancing figures are well known in the art and have employed many various aesthetic novelty designs, from flowers (U.S. Pat. No. 5,056,249) and soda cans to fish (U.S. Pat. No. 4,775,351). However, these lack the innovation to create complex animated movements needed for dolls and for various other standing figures.

While the prior art is not devoid of dancing dolls, toys or other figures, there are disadvantages in the prior art and areas that need improvement. For instance, one disadvantage exists in animated figures that are fixed on a base in order to provide stability, lacking a more lifelike appearance that free-standing figures provide. These non-free standing figures typically include the mechanisms that create or control the movements of the figure in the base and are often comprised of moveable rods that travel through the legs. These dancing toys may be represented in U.S. Pat. Nos: 6,163,992; 6,126,508; 5,601,471; and 5,273,479. Other non-free standing figures incorporate the mechanisms in the upper or lower torso, but since this type of arrangement causes the figure to be top-heavy, the figures rely on the base to keep the figures upright. For example, U.S. Pat. No. : 6,261,148 discloses a twisting figure; U.S. Pat. No. 6,071,170 discloses a figure that vibrates and moves side to side; and U.S. Pat. No. 5,735,726 illustrates an animated figure that stands and sits.

While free-standing animated dolls are present in the art, these dolls similarly place the mechanisms in the torso, which as mentioned above may cause instability. To compensate for this the dolls typically reduce the speed or rate of animation and movement the dolls produce. As such these dolls typically only walk, illustrated in U.S. Pat. No. : 5,820,441; tap dance, disclosed in U.S. Pat. No. : 5,147,238; or sway from one side to another, shown in U.S. Pat. No. : 5,911,617.

Another interesting disclosure is found in U.S. Pat. No. 5,176,560, which discloses a free-standing dancing doll. However, the mechanism that powers the movement is situated in the torso of the doll, which as mentioned above may limit the speed of the movements in order to keep the toy upright.

As such there exists a need to improve upon the prior art without the disadvantages outlined above. In addition thereto, typical dancing figures and toys animate in response to detecting music or sound, while others may be simply animated at the same time the figure plays music providing the appearance that the figure is dancing. As such a further improvement over the prior art would include the ability to control the animation of the figure.

SUMMARY OF THE INVENTION

In accordance with the present invention, there is provided in one embodiment a dancing figure that includes a body defined by a torso, a head, and a pair of arms, and a pair of legs pivotally attached to the torso at a hip region. Each leg includes at least an upper leg section pivotally attached to a lower leg section at a knee region. Also included therewith is a pair of oversized feet adapted to provide support such that the figure is free-standing. Each oversized foot is separately and pivotally attached to one of the lower leg sections at an ankle region. Each foot houses a foot mechanism for independently pivoting the lower leg sections forwards and backwards at the ankle region, wherein the pivoting at the ankle regions causes pivoting motion at the knee regions and hip region to simulate animated movement in the figure. In addition thereto the foot mechanism may also include the ability to independently twist the feet to the left and right. A control means is further in communication with each foot mechanism and may include pre-programmed animation or dance movements.

In another embodiment of the present invention each foot may include front and rear wheels. By operably connecting the rear wheels to the foot mechanism, the feet may be moved forwards or backwards. The feet may also include a foot position indicator means such that the control means can determine the position of each foot to properly control the direction and speed the feet are moving.

In another embodiment of the present invention the figure may be remotely controlled from a remote control unit Various means to transmit and receive the signals may be employed. The remote control unit further includes function buttons to move the feet independently of each other and at various speeds and include buttons to activate the pre-programmed animated movements.

In another embodiment of the present invention the figure includes a sound activation means in communication with the control means such that the figure will move or dance in response to music or sounds. The figure or remote control unit may also include a speaker to emit songs pre-recorded and stored on the control means.

The remote control unit may then further include an input jack to attach a separate audio unit, such as an MP3 player, CD or cassette player or even a stereo, such that the music from the auxiliary player is emitted through the speaker in the remote control unit.

The figure may also include a beat sensor in communication with the control means. The beat sensor determines the beat of a song and indicates to the control means to change the speed of the dancing or pre-programmed animation sequences. The beat sensor may also be placed in the remote control unit and configured to send a beat signal to the receiver in the figure.

Numerous other advantages and features of the invention will become readily apparent from the following detailed description of the invention and the embodiments thereof, from the claims, and from the accompanying drawings.

BRIEF DESCRIPTION OF THE FIGURES

A fuller understanding of the foregoing may be had by reference to the accompanying drawings, wherein.

DETAILED DESCRIPTION OF THE INVENTION

Figure 1A:
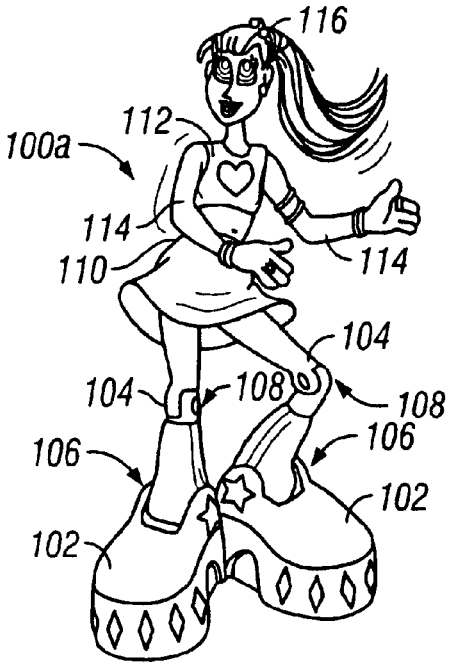
FIGS. 1*a*–1*d* illustrates various external designs embodying the present invention.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or claims of the embodiments illustrated.

Figure 1B:
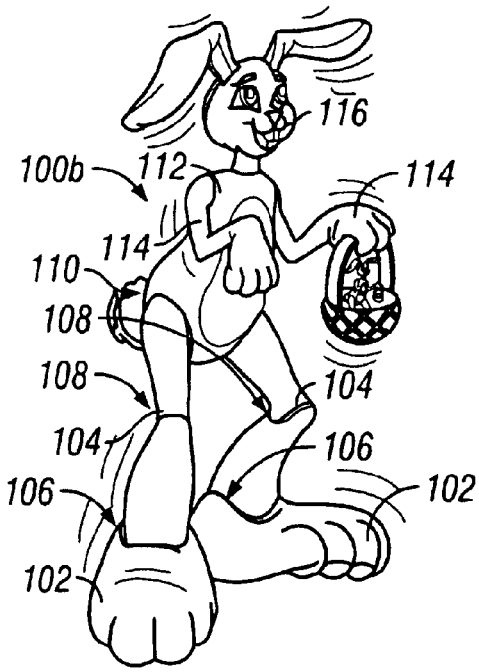
Figure 1C:
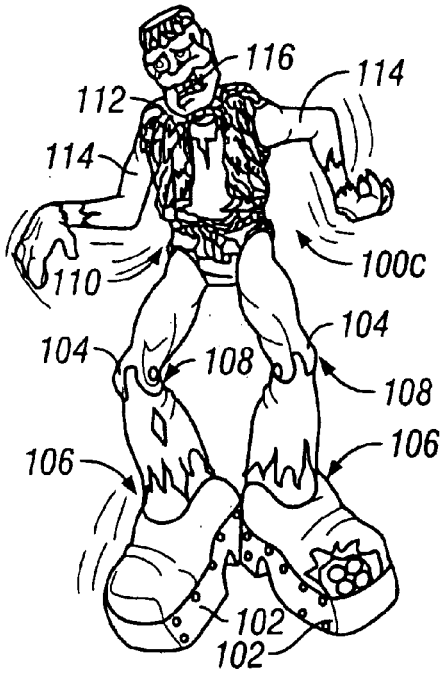
Figure 1D:
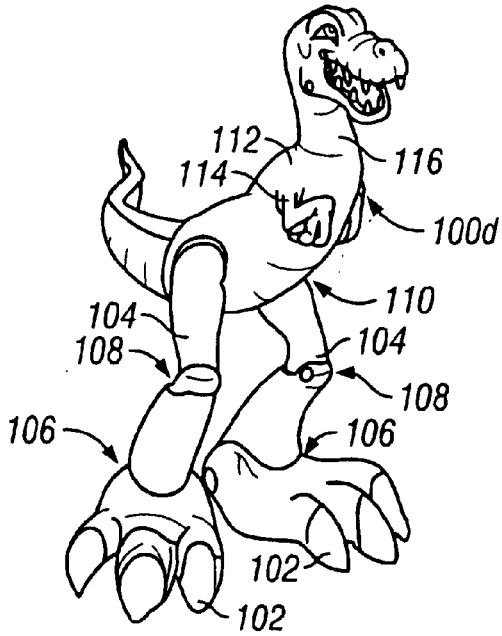

Referring now to FIGS. 1*a* through 1*d* there are shown various illustrated dancing FIGS. 100 in accordance with the embodiments and disclosures herein below. It is contemplated by the present invention that external features of the FIGS. 100 should not limit the scope of the underlying invention, as each FIG. 100 is illustrated by a different character: FIG. 1*a* illustrates a girl $\mathbf{100}_a$, FIG. 1*b* illustrates a rabbit $\mathbf{100}_b$, FIG. 1*c* illustrates a monster $\mathbf{100}_c$, and FIG. 1*d* illustrates a dinosaur $\mathbf{100}_d$, moreover, other external features or characters not shown may also be contemplated, such as robots, male characters, insects, animals, etc.

As illustrated, each FIG. 100 includes a pair of oversized feet 102. Within each oversized foot 102 are housed drive mechanisms that are independently powered to drive or move each leg 104 independently from the other. In one embodiment the mechanisms separately power a series of links that transverse each leg 104. The links are pivotally connected to each other at specific areas defined in an ankle region 106, knee region 108 and hip region 110, which permit the legs 104 to bend or pivot at these regions. When the legs 104 are moving rapidly, the feet 102 will separately move or shuffle across the surface because of the momentum and weight transfer exhibited through the rapid motion in the legs 104, upper body 112 and the hip region 110. As such the FIG. 100 can be controlled or programmed to dance or move around in circles, forwards or backwards. The oversized feet 102, besides housing the mechanisms and power supplies, serve as a base such that the dancing figure is free-standing and does not need to be permanently attached to a separate base. The arms 114 and the head 116 may also be pivotally connected to move freely in response to the momentum of the dancing figure such that when the legs 104 move, the arms swing forwards and/or to the side, while the head pivots to the side.

Figure 2A:
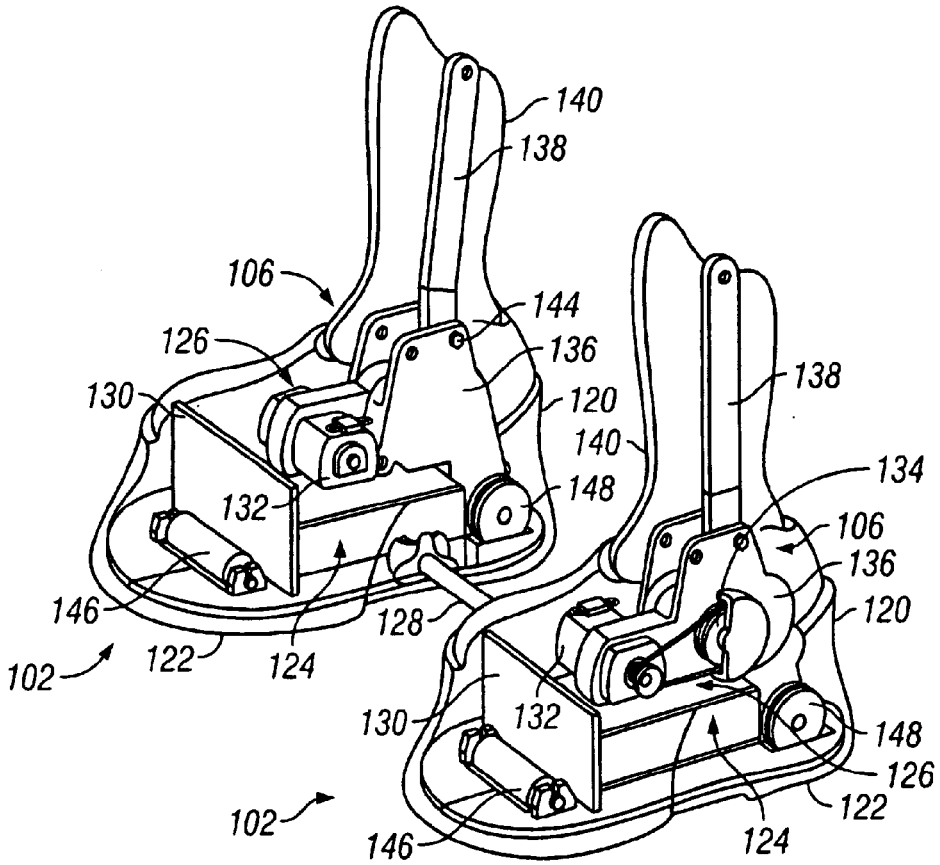
FIG. 2*a* is a perspective view in outline of one embodiment of the feet and lower leg sections showing the foot mechanisms and lower leg links.
Figure 2B:
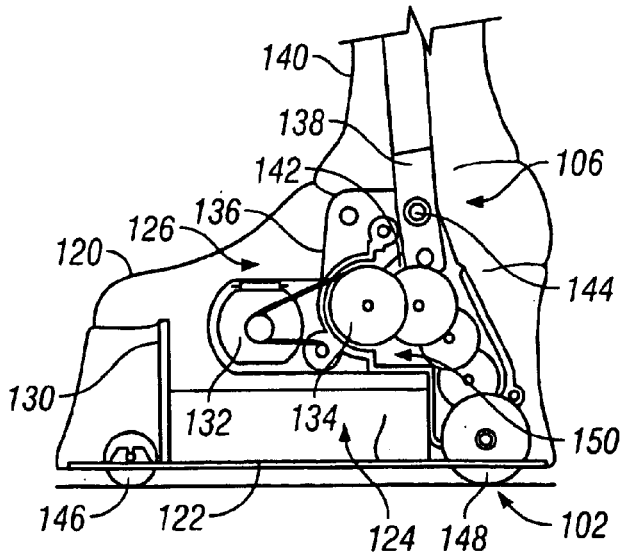
FIG. 2*b* is a side view in outline of the motor mechanism and gear train in communication with the rear wheel of one of the feet illustrated in FIG. 2*a;*

Referring now to FIGS. 2*a* and 2*b*, as mentioned above, the FIG. 100 includes a pair of oversized feet 102. Each foot 102 is defined by an outer foot housing 120 that encloses a bottom section 122. When the feet 102 do not include wheels, illustrated in other embodiments herein-below, the bottom section 122 is substantially flat in order to provide a base for the FIG. 100 to stand upon. Each foot 102 houses a foot mechanism 126 and the power supply 124. The power supply 124, preferably a battery pack (not shown), is accessible through a battery door (not shown) in the bottom section 122 of the foot 102. Also contained within each foot 102 is a circuit board 130 or other microprocessor or control means, which is in communication with the power supply 124 and its respective foot mechanism 126. The circuit boards 130 are typically connected to each other through various well known communication means, which may run internally through the body or may run through a communication foot link 128, if for instance such communication means were wireline based, however various wireless communication means may also be included.

The communication foot link 128 is pivotally attached to the inside portion of each foot 102. The communication foot link 128 is designed such that each foot 102 may still move independently of each other without being impeded by the other due to the communication foot link 128 pulling against the moving foot. However, as explained above other communication means may be employed.

The foot mechanism 126 includes a motor 132 that drives a crank 134, which is housed in a crank enclosure 136. The crank 134 is connected to one end of a lower leg link 138, which extends out of the outer foot housing 120 and is housed within the lower leg section 140. The connection between the crank 134 and the one end of the lower leg link 138 is accomplished by a connecting rod 142 (best seen in FIG. 2*b*). The lower leg link 138 is pivotally connected by a first pivoting means 144 to the crank enclosure 136 about the ankle region 106. When the crank 134 rotates, the connecting rod 142 moves inwardly and outwardly, which further pivots the lower leg link 138 forwards and backwards (illustrated in further detail below).

In addition, each foot 102 is equipped with freely rotatably front wheels 146 and rear wheels 148 operably connected to the foot mechanism 126 through a gear train 150. The rear wheels 148 are powered to rotate forwards and backwards. However, in other embodiments the gear train 150 may include a slider gear that only engages the rear wheel 148 when the motor 132 is running in a pre-specified direction, such as forwards, thereby preventing the rear wheels 148 from rotating in reverse.

Figure 3A:
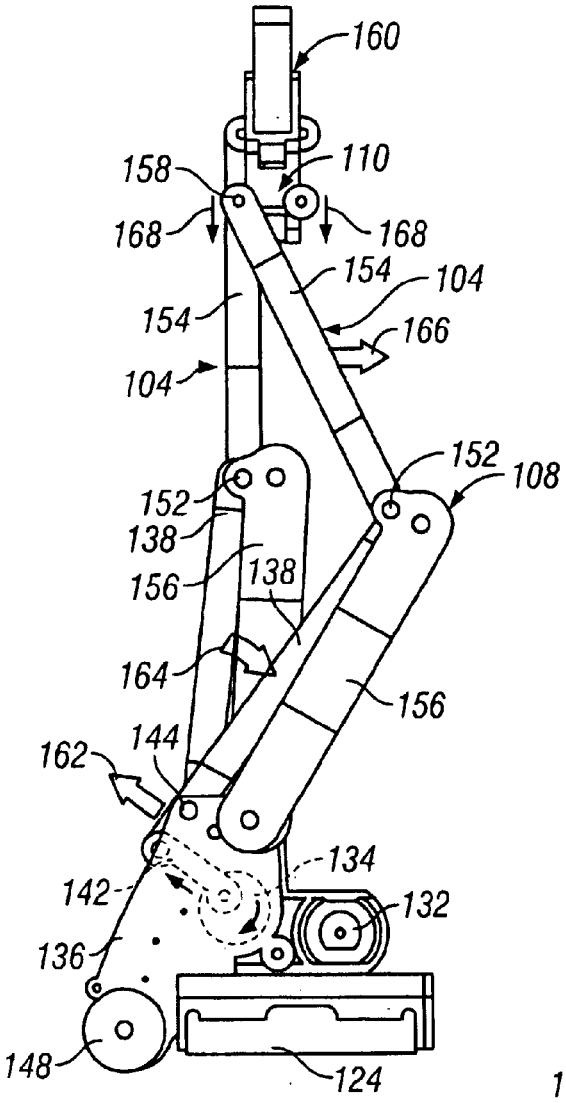
FIG. 3*a* is a side view of the internal components of the legs and oversized feet, for one embodiment of the present invention illustrating the pivotal connections at the ankle, knee and hip regions when the leg is in a forward position.
Figure 3B:
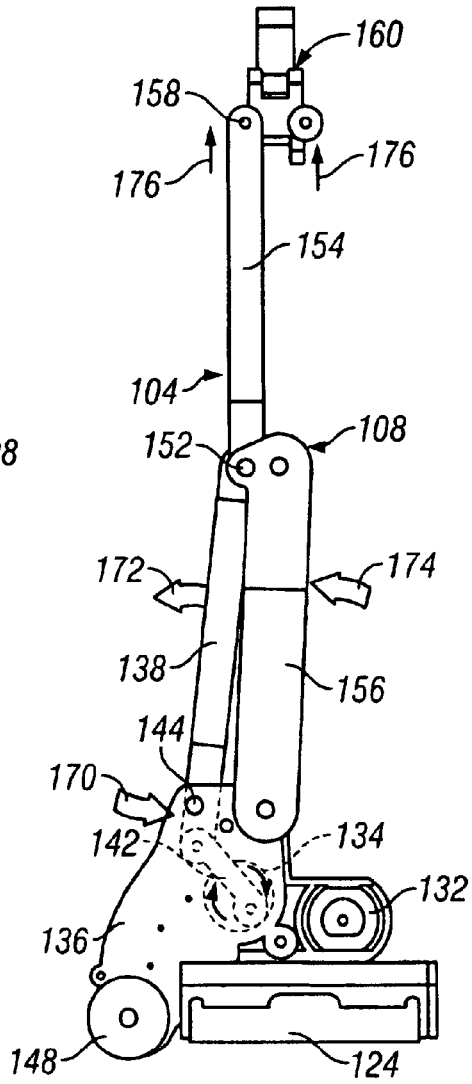
FIG. 3*b* is another side view of FIG. 3*a*, when the leg is in an upright position.

Referring now to FIGS. 3*a* and 3*b*, as mentioned above, the lower leg link 138 is fastened at one end to the connecting rod 142, which is operably connected to the crank 134. The other end of the lower leg link 138 is pivotally attached by a second pivoting means 152 to one end of an upper leg link 154, which is housed within the upper leg section (not shown). The lower leg section 140, of which only the front portion 156 is illustrated, is also pivotally attached to the crank enclosure 136 and pivotally attached to the upper leg link 154 by the second pivoting means 152. The pivotal connection at the knee region 108 by the second pivoting means 152 permits the legs 104 to bend in a more life-like fashion. Continuing therefrom, the other end of each upper leg links 154 is pivotally connected to a hip mechanism 160 by a third pivoting means 158 at the hip region 110.

When the crank 134 is operating (FIG. 3*a*), the connecting rod 142 moves outwardly indicated by arrow 162. The lower leg link 138, in response thereto, pivots forwards indicated by arrow 164 at the ankle region 106, causing the upper leg link 154 to pivot forwards, indicated by arrow 166 at the knee region 108. The other end of the upper leg link 154, attached to the hip mechanism 160, pulls that specific side of the hip mechanism 160 down in response to the upper leg link 154 pivoting forwards, indicated by arrows 168 and explained in greater detail below. Referring now to FIG. 3*b*, as the crank 134 continues to rotate, the connecting rod 142 moves inwardly, indicated by arrow 170, pivoting the lower leg link 138 and the lower leg section 156 backwards, indicated by arrow 172 and 174 respectively. This in turn pivots the upper leg link 154 inwards (back horizontally) pushing the hip mechanism 160 upwards, which is indicated by arrows 176.

Figure 4:
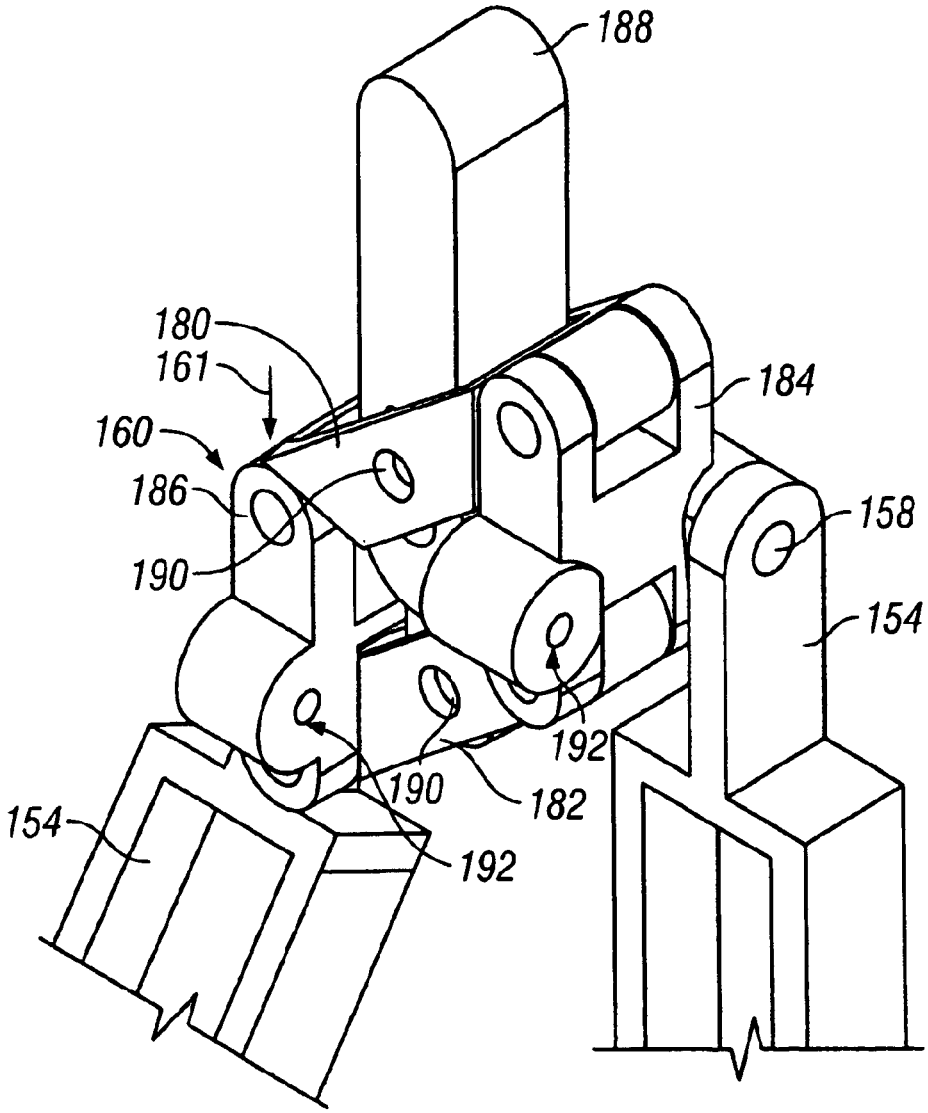
FIG. 4 is a perspective view of a hip mechanism for the figure illustrated in accordance with FIGS. 3*a* and 3*b;*

Referring to FIG. 4, the hip mechanism 160 is defined as having a pair of parallel horizontal sides 180 and 182 that are pivotally connected on their ends to the ends of a pair of vertical parallel sides 184 and 186, forming a pivotal parallelogram. Intersecting through the hip mechanism 160 is a hip post 188 that is pivotally attached approximately to the middle portion 190 of the pair of horizontal parallel sides 180 and 182. The connections permit the hip post 188 to remain parallel to the pair of vertical parallel sides 184 and 186 when the hip mechanism 160 pivots, causing the hip post 188 to remain substantially upright. As mentioned above, the upper leg links 154 are pivotally attached, via the third pivoting means 158, to the hip mechanism 160. The hip mechanism 160 further includes the means to fasten 192 the upper leg housing (not shown), which encloses the upper leg links 154.

Figure 5:
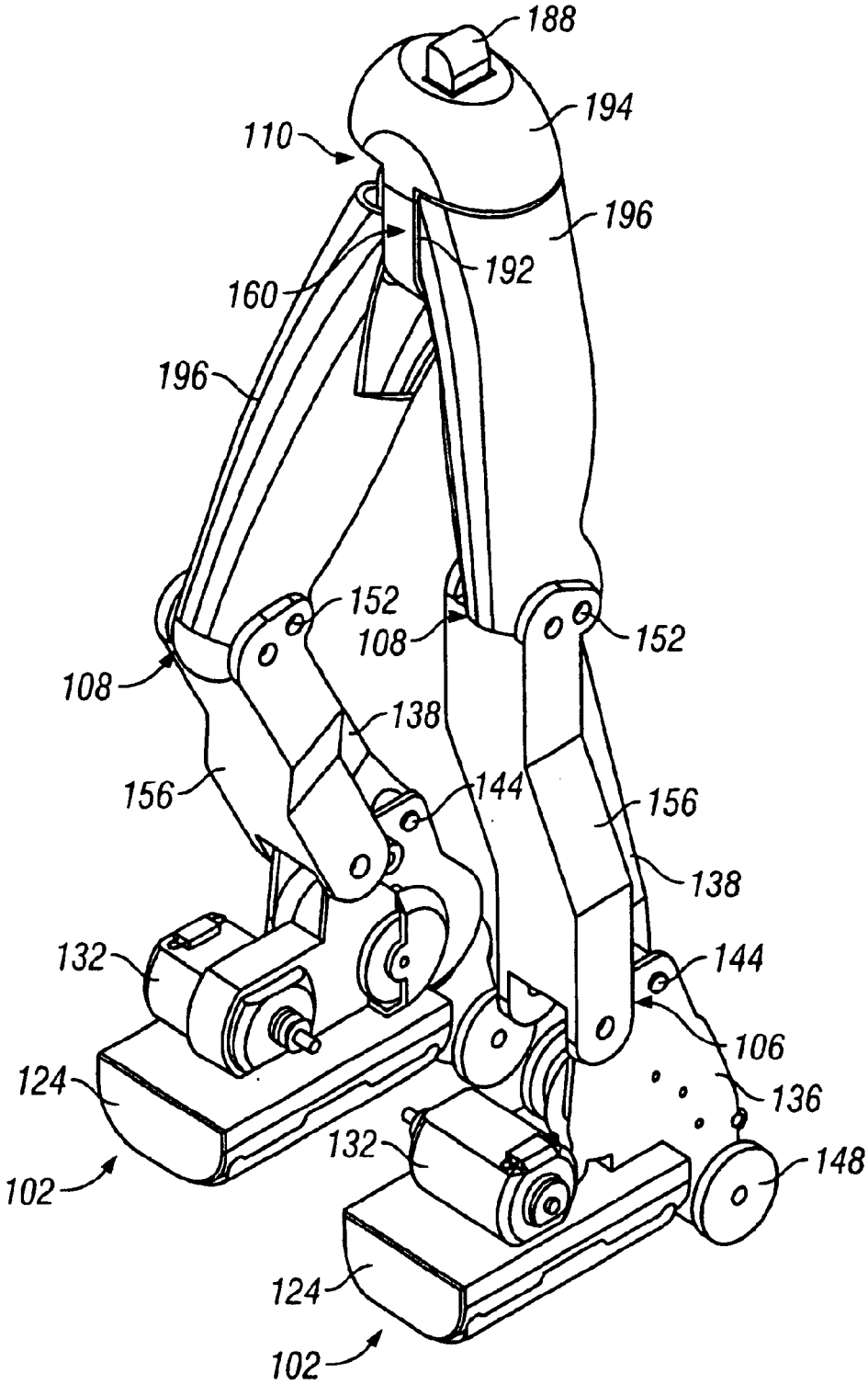
FIG. 5 is a perspective view of the lower half of the figure in accordance with FIGS. 3*a* and 3*b* illustrating the outer covering of the upper leg sections and hip region.

Referring to FIG. 5, the hip mechanism 160 is enclosed in a lower torso 194 and the hip post 188 extends upwardly from the hip mechanism 160 such that the upper torso (not shown) may be attached thereto. However, the lower and upper torso may be a single piece structure that encloses the hip mechanism, which as such would eliminate the need for a hip post 188. The upper leg links 154 are enclosed in upper leg housings 196 that attaches to the hip mechanism 160 by fastening means 192.

As one of the upper leg links 154 pivots at the knee region 108, the same upper leg link 154 pulls on the hip mechanism 160 causing the pivotal parallelogram to flex downwardly towards the same upper leg link 154 (seen also in FIG. 4 and indicated by arrow 161). As such the FIG. 100 exhibits more lifelike complex dance or animation movements by having a FIG. 100 with legs 104 that pivot at the ankle region 106, bend at the knee region 108 and attach to the upper body at the hip region 110 that flexes downwardly when the legs 104 pivot and bend outwardly. In addition the torso 112 while remaining substantially upright will exhibit movement in the arms and head (when pivotally attached thereto) because of the momentum exhibited through the lower portion of the FIG. 100.

In one embodiment of the present invention, the FIG. 100 is activated in response to sound or music. A sound activation means (not shown) is in communication with the circuit boards 130 in order to activate the animation of the FIG. 100. The sound activation means may be located in one of the feet 102 or in the upper body of the FIG. 100 and is responsive to any music the user plays. The animation of the FIG. 100 may be controlled through pre-programmed animation sequences or combinations of dance moves. In response to the music, the circuit board controls the feet mechanisms 126 in accordance to pre-programmed commands, which cause the FIG. 100 to move through various animation sequences.

In another embodiment of the present invention, the FIG. 100 may also include a beat sensor (not shown) in communication with the circuit board 130. The beat sensor determines the beat or pace of the user's music and sends a beat signal to the circuit board 130. The circuit board 130 receiving the beat signal can then replay the pre-programmed animated sequences in-time with the beat of the user's music, by speeding or slowing down the pre-programmed animated sequence.

In other embodiments of the present invention, the FIG. 100 may also playback pre-recorded music. Incorporating a speaker (not shown) in the upper body of the FIG. 100 or in one of the feet 102 would permit the figure to emit the music. The FIG. 100 may also include an on/off switch in connection with the circuit board 130 that permits the user to control the playback of the music. Once the playback option is turned on, the circuit board 130 begins to emit the pre-recorded music through the speakers. The FIG. 100 also including the sound activation means will then begin to move (as described above) in response to the music.

Figure 6A:
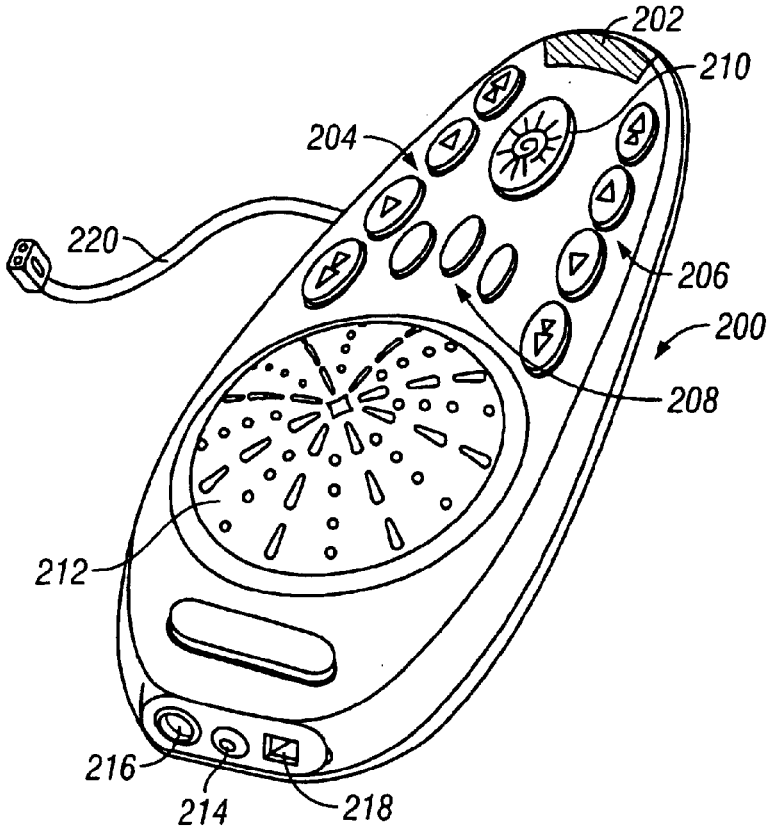
FIG. 6*a* is a perspective view of a remote control unit for controlling the movement of the figures.

Referring now to FIG. 6*a*, in another embodiment of the present invention, a hand-held remote control unit 200 controls the movements of the FIG. 100 remotely. The remote control 200 includes an IR transmitter 202, which transmits the control signals from the remote control 200 to a receiver (not shown) in the FIG. 100. The receiver is in communication with the circuit board(s) 130, which independently controls the foot mechanisms. It is however, contemplated that other transmitter/receiver combinations may be used, for instance the transmitting/receiving means may include radio frequency ("RF") transmitters and receivers.

The remote control unit 200 incorporates various function activation buttons. For example, a set of foot control buttons 204 positioned on the left hand side of the remote control unit 200 may control the left leg (or the foot mechanism in the left foot) of the FIG. 100, while a set of foot control buttons 206 positioned on the right hand side may control the right leg (or the foot mechanism in the right foot). These buttons may include the ability to move the feet separately forwards and backwards and at different speeds. In addition the activation of both sets of foot control buttons 204 and 206 may cause the figure to move forwards or backwards. In addition moving only one of the foot control buttons forwards may cause the figure to continuously bend the corresponding leg forwards and rotate or pivot about the other foot.

A third set of music control buttons 208 may be included to control or alter the music being played. The music control buttons 208 may change the beat or speed of the music or may allow the user to cycle through a variety of pre-recorded songs. The music control buttons 208 may also permit the user to mix the songs by controlling the bass, rhythms and melodies of each song, such as adding different basses or rhythms to alter or manipulate the music slightly. One of the music control buttons 208 may also turn the music off to permit the user to play their own music.

The remote control unit 200 may also include a pre-programmed dance button 210 that activates pre-programmed animation sequences. By depressing the pre-programmed dance button 210, the FIG. 100 will move in accordance to one of its pre-programmed sequences. It is further contemplated by the present invention that the remote control unit 200 may be designed such that the user may only be capable of activating various pre-programmed dance sequences and unable to independently control each foot. The remote control unit 200 may however, be further designed to allow the user to move the FIG. 100 forwards or backwards through various means described herein (such as by controlling various wheel mechanisms in communication with each foot mechanism). The remote control unit 200 may also include a freeze button (not shown) that temporarily stops all movement of the FIG. 100, while the FIG. 100 is in its specific dance sequence. This would thereby allow the user to view the FIG. 100 in various poses, such as with one leg off the ground.

In addition thereto, the remote control unit 200 may also include a speaker 212 that emits the pre-recorded music. As such, the user will be able to hear the music better through the remote control unit 200 rather than from the FIG. 100, which may be too far away from the remote control unit 200. The remote control unit 200 may also include an input jack 214 that permits a transfer cable (not shown) to be attached to the remote control unit 200, which attaches to a separate audio player, such as a CD and/or cassette player or a radio. As such the user's music will emit through the speaker 212 contained in the remote control unit 200. In such embodiments, the function buttons may be capable of adding various sound effects to the user's music. Other aesthetic features of the remote control unit 200 may include an "in use" indicated LED, or other designs on the foot control buttons, such as finger joysticks, or mini-pads, or other accommodating controls. The remote control unit 200 may also include a headphone jack 216.

Figure 6B:
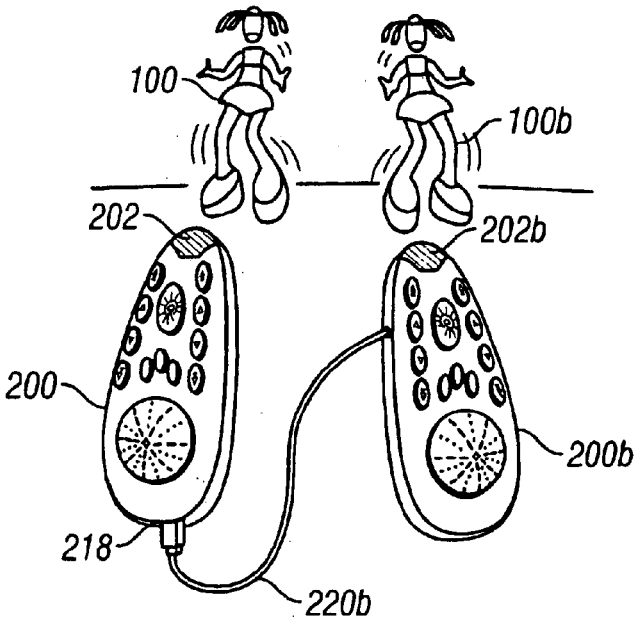
FIG. 6*b* illustrates uses a single remote control unit that is plugged into a second remote control unit similarly configured in order to control the dancing or moving of two similarly configured figures.

In addition thereto, the remote control unit 200 may also include a multi-controller jack 218 with a corresponding connection cord 220. Illustrated in FIG. 6*b*, a second remote control unit 200*b*, similarly configured has a connection cord 220*b* that is plugged into the multi-controller jack 218, of the remote control unit 200. When the two remote control units 200 and 200*b* are plugged into each other, a user using one of the remote control units will be able to control two FIGS. 100 and 100*b*.

Alternatively, the connection of the two remote control units 200 and 200*b* may permit the music from the first remote control unit 200 to overlap and play through the second remote control unit 200*b*, such that the two FIGS. 100 and 100*b* will be dancing to the same music. In yet an alternate embodiment, linking the two remote control units would permit the two remote control units to separately control the two figures. While one remote control unit is transmitting the other remote control unit would wait (by being blocked from sending a transmission) before making its own transmission. This allows for independent control of the two figures at the same time while sharing the single audio sound.

In yet another embodiment of the present invention, the remote control unit 200 may also include a beat sensor, as described above. As such when a user attaches a separate audio player into the remote control unit 200, the beat sensor determines the beat or pace of the user's music and sends a beat signal to the circuit board 130 of the FIG. 100. The figure receiving the beat signal can then replay the pre-programmed animated sequences in-time with the beat of the user's music, by speeding or slowing down the animated sequence. The figure receiving the beat signal, may further speed up or slow down the pace in which the remote control unit controls the figure, such that the user controlling the figure's animation will be able to move the figure in-time with the user's music.

Figure 7A:
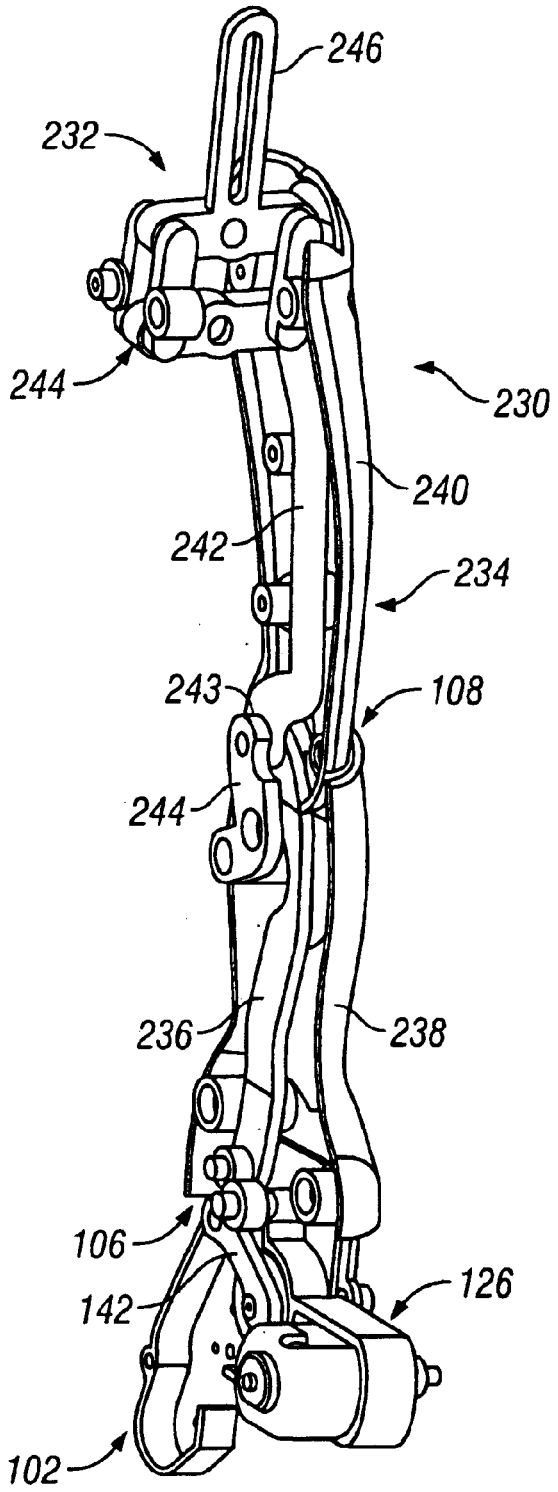
FIG. 7*a* is a perspective view of a leg in accordance with another embodiment of the present invention showing upper and lower leg links in communication with a foot mechanism and a hip mechanism and showing the outside portion of the leg housings.
Figure 7B:
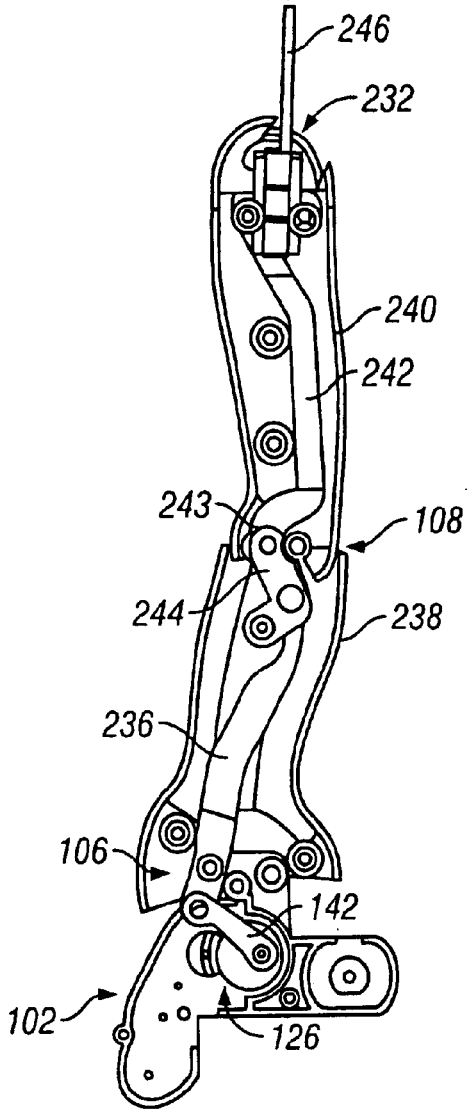
FIG. 7*b* is a side view of the leg from FIG. 7*a;*
Figure 7C:
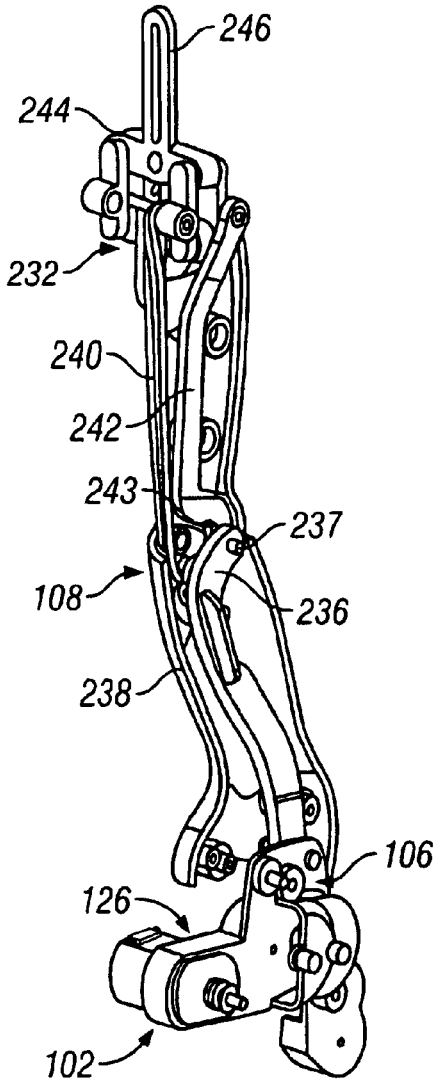
FIG. 7*c* is a reverse perspective view of the leg from FIG. 7*a* with the outside portion of the leg housings being replaced with the inside portion of the leg housings.

In another embodiment of the present invention, a dancing or animated FIG. 230 is partially illustrated from its hip mechanism 232 down in FIGS. 7*a* through 7*c*. The FIG. 230 includes a pair of oversized feet 102 configured similarly to the any of the oversized feet described herein above or below. Each oversized foot 102 is pivotally attached to a leg 234 about the ankle region 106. As described above, each oversized foot 102 includes a foot mechanism 126 that drives a connecting rod 142. Referring now to FIGS. 7*a* through 7*c*, the connecting rod 142 is attached to one end of a lower leg link 236, of which such end of the lower leg link 230 is also pivotally attached at the ankle region 106 to the oversized foot 102. When the connecting rod 142 is moving, the lower leg link 230 is pivoting forwards or backwards about the ankle region 106. The lower leg link 230 is further secured in a lower housing 238.

Rather then attaching the lower leg link 236 to an upper leg link 242, the other end of the lower leg link 236 includes a pin 237 that pivotally attaches to the upper leg housing 240. The upper leg housing 240 includes an upper leg link 242 that is secured therein and has one end 243 that is pivotally attached to a middle leg link 244. The middle leg link 244 is secured to the lower leg housing 238, such that the upper leg link 242 is pivotally attached to the lower leg housing 238. When the lower leg link 236 pivots the lower leg housing 238, both the upper leg housing 240 and the upper leg link 242 pivots therewith respectively.

The hip mechanism 232 is preferably in this embodiment a pivotal parallelogram 244 that includes a hip post 246 that extends from the top portion of the pivotal parallelogram 244. When the pivotal parallelogram pivots to one side the hip post 246 will move accordingly therewith, causing a torso (not shown) attached thereto to tilt to one side. As mentioned in the previous embodiment, the upper leg links 242 and the upper leg housings 240 are pivotally attached to the sides of the hip mechanism 232. When operating, the movement in the legs causes the torso to tilt to one side, exhibiting a greater amount of motion in the upper body.

Figure 8A:
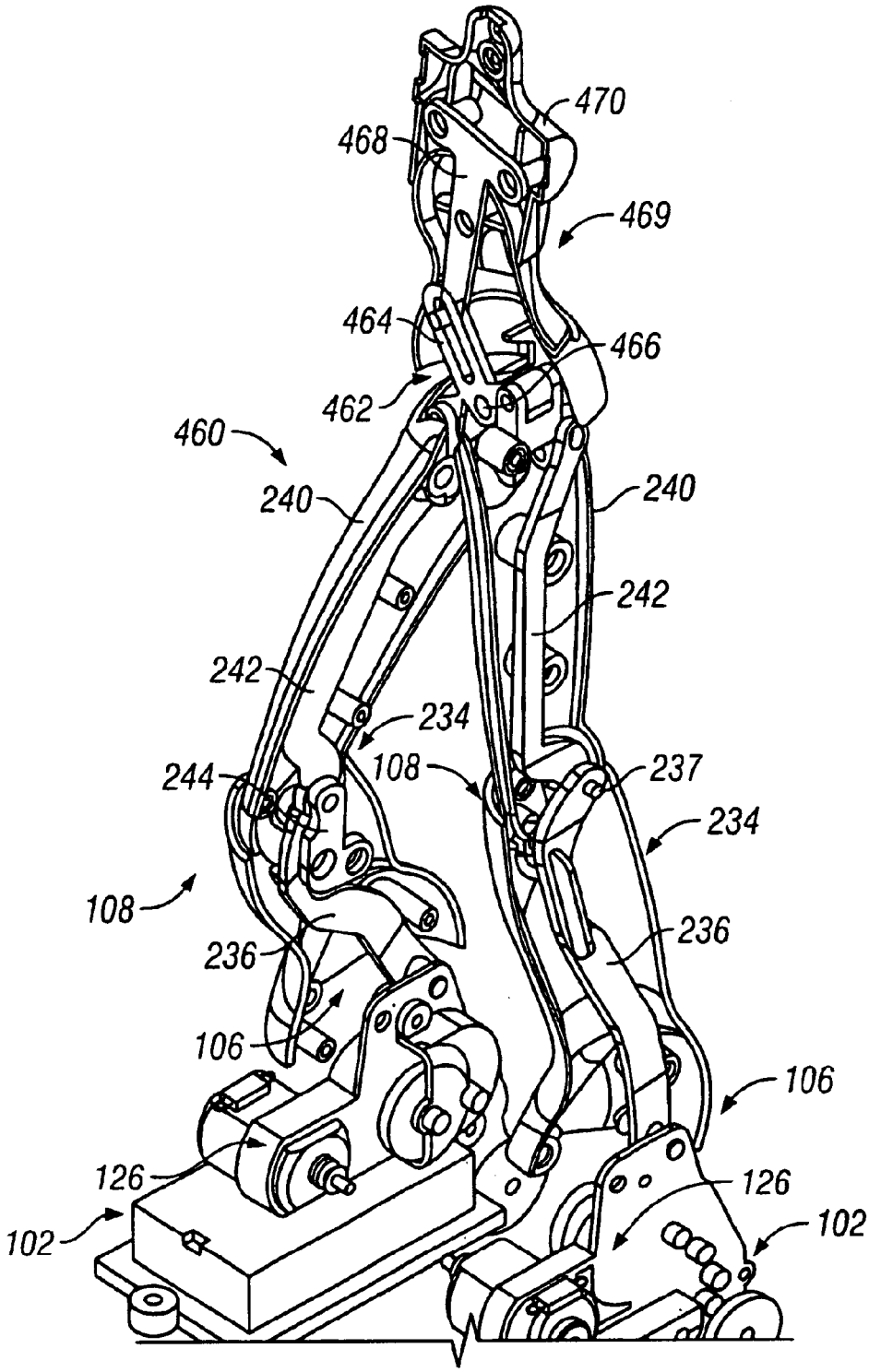
FIG. 8*a* is a perspective view of the internal links defined with another embodiment of the present invention showing upper and lower leg links in communication with foot mechanism and a hip mechanism that is further in communication with links in the torso.
Figure 8C:
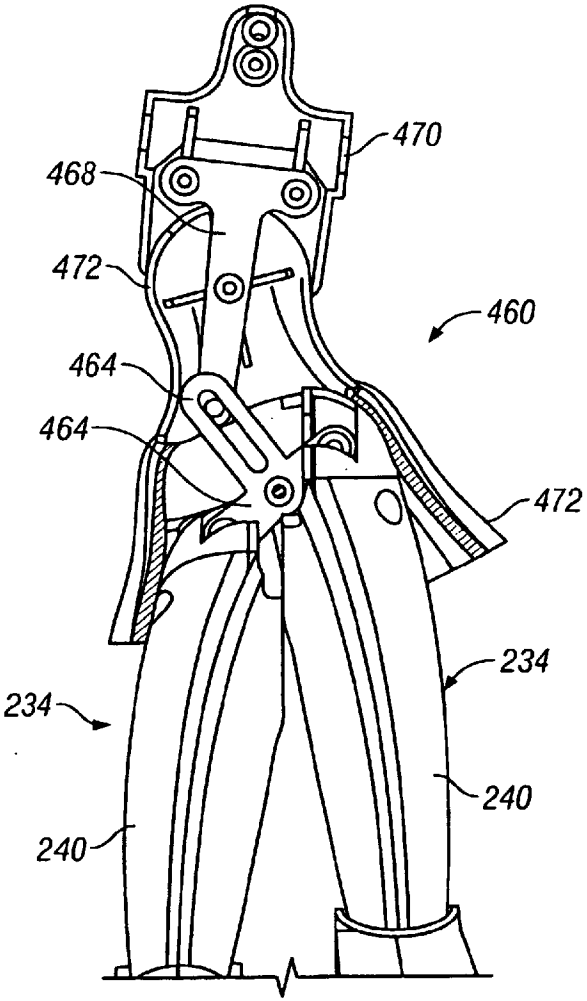
FIG. 8*c* is a front view of the hip mechanism and internal links of the torso with a skirt that is to wrap around the hip region of the figure from FIG. 8*a;*
Figure 8B:
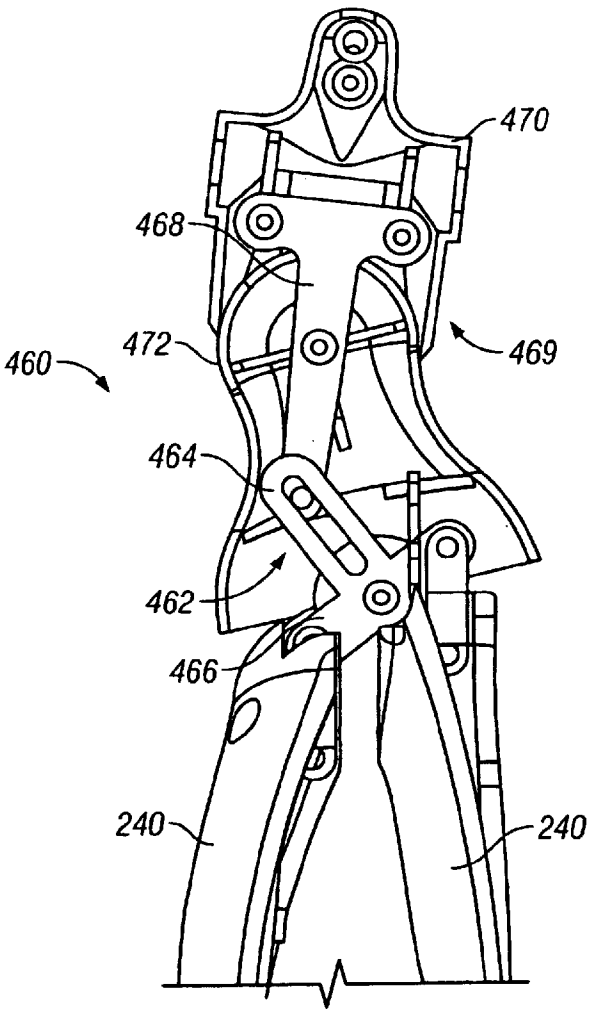
FIG. 8*b* is a front view of the hip mechanism and internal links of the torso from FIG. 8*a;*

Referring now to FIGS. 8*a* through 8*c* a FIG. 460 illustrated in accordance with another embodiment of the present invention with similarly configured legs 234 to the embodiment disclosed with reference to FIGS. 7*a* through 7*c*. However, the FIG. 460 includes another hip mechanism 462. The hip mechanism 462 is defined a being T-shaped post, having a middle portion 464 projecting from the middle section of a base portion 466. The base portion 466 is pivotally attached to the torso 469 and includes a pair of opposing ends that includes means to pivotally connect the legs 234. The middle portion 464 will coact with a second T-shaped post 468 connected to the upper portion 470 of the torso 469. The movement of the hip mechanism 462 will tilt the middle portion 472 of the torso 469 therewith and cause the upper portion 470 of the torso 469 to tilt in the opposite direction. To prevent the legs 234 from moving too far apart, the FIG. 460 preferably includes the communication foot link (not shown). However, other means may be employed to limit the movement of the legs, if deemed necessary.

Referring to FIG. 8*c* the FIG. 460 may further include a skirt 472 wrapping around the middle portion 472 of the torso 469. The skirt 472 acts to prevent the torso 469 from tilting to far in one direction, as it will be impeded by the skirt 472.

In another embodiment of the present invention, a dancing or animated FIG. 250 is partially illustrated from the lower torso down in FIGS. 9*a* through 12. The FIG. 250 includes a pair of oversized feet 252 that may be configured similarly to one of any of the embodiments disclosed herein. The figure includes a pair of legs 254 that are interconnected to the feet 252 and lower torso (not shown) that permit the legs to pivot at an ankle region 256, bend at a knee region 258 and twist at a hip region 260. Each leg is separated into three sections, a lower leg section 262 that is pivotally connected to a corresponding foot 252, an upper leg section 264 that is pivotally connected to the lower leg section at the knee region 258, and a thigh section 266 that is rotatably secured within the upper portion 268 of the upper leg section 264 and that is attached to a hip mechanism 270.

Figure 9A:
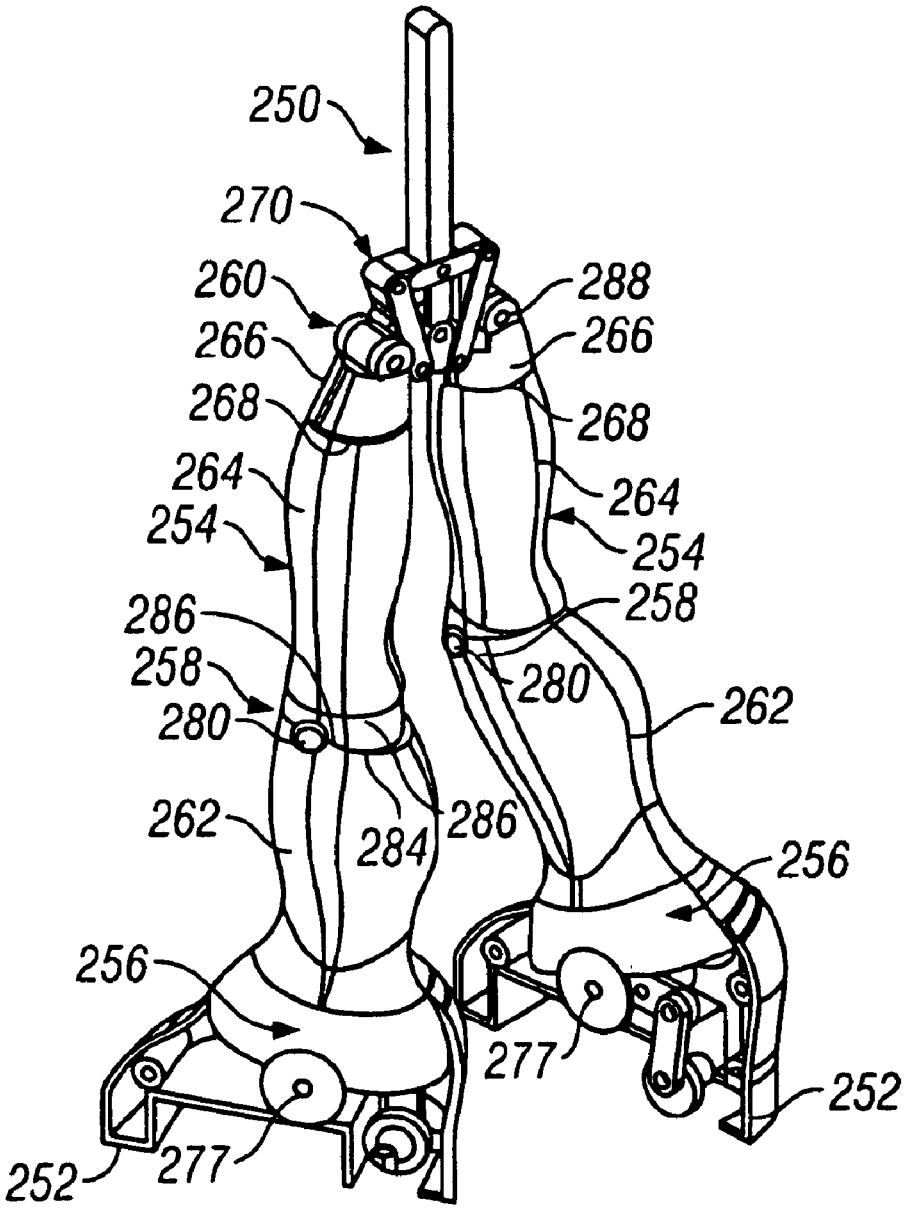
FIG. 9*a* is a perspective view of the legs and hip mechanism of another embodiment of the present invention showing the leg pivoting about the ankle region.
Figure 9B:
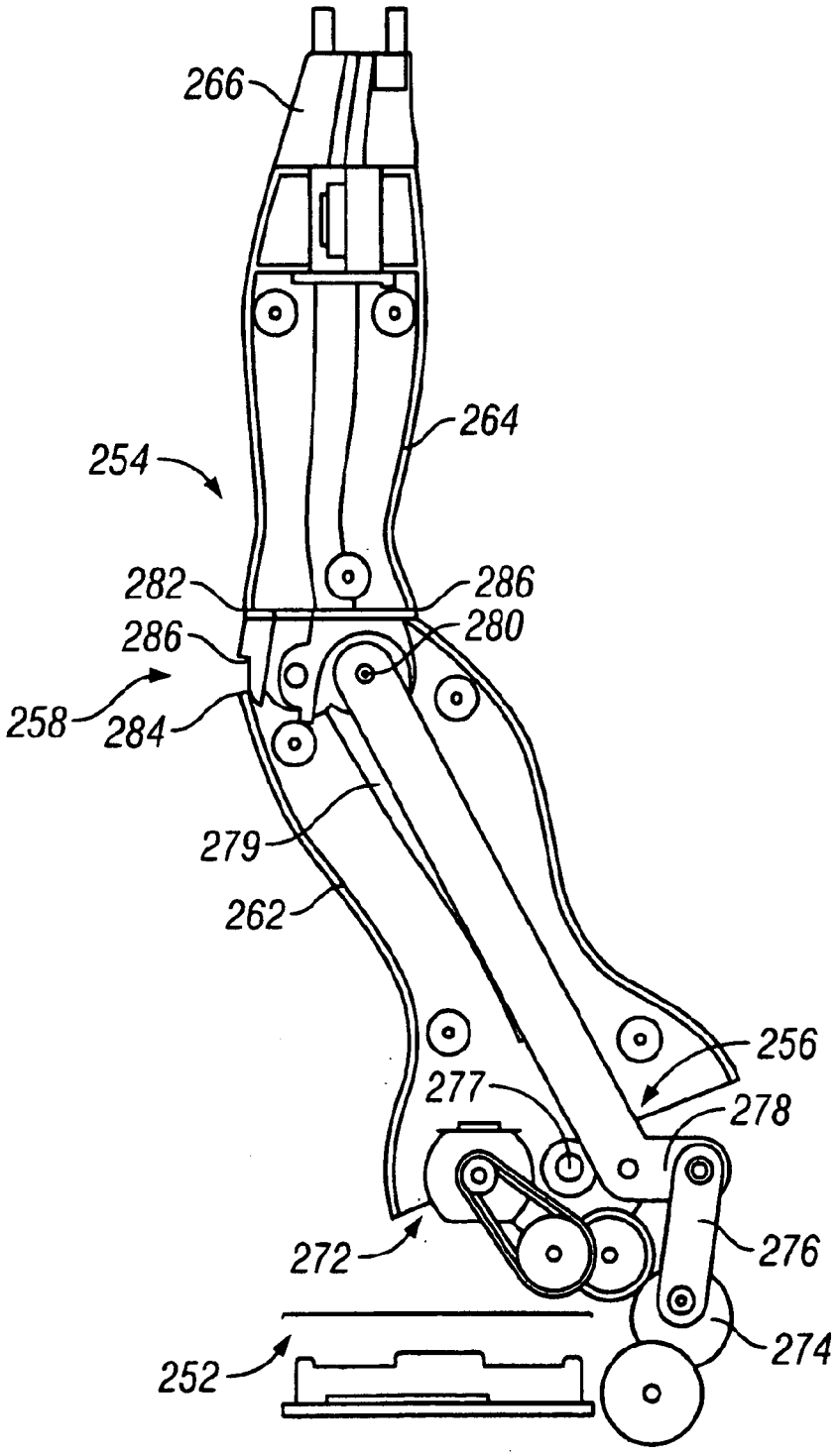
FIG. 9*b* is a cross section view of one of the legs from the embodiment in FIG. 9*a;*

Referring now to FIG. 9*b*, each foot 252 includes a foot mechanism 272 (as described above) that rotates a crank 274. The crank 274 is attached to a connecting rod 276 that is further connected to one end of a lower leg link 278, which is secured within a groove 279 in the lower leg section 262. The lower leg section 262 is further pivotally attached to the foot 252 about a foot pivot point 277. When the lower leg link 278 is moved, it pivots the lower leg section 262 about the foot pivot point 277 by pushing forwards or backwards against the inside of the lower leg section 262. The other end of the lower leg link 278 is pivotally attached to the upper leg section 264 about a knee pivot point 280 at the knee region 258. To prevent the upper leg section 264 from pivoting forwards or backwards too much, the end 282 of the upper leg section 264 protrudes downwardly and inwardly into the end 284 of the lower leg section 262, creating a front and rear edge 286 on the end 282 of the upper leg section 264 (also illustrated in FIG. 10*a*). When pivoting, the lower leg section 262 moves until the end 284 of the lower leg section 262 comes into contact with either the front or rear edge 286 on the end 282 of the upper leg section 264.

Figure 10A:
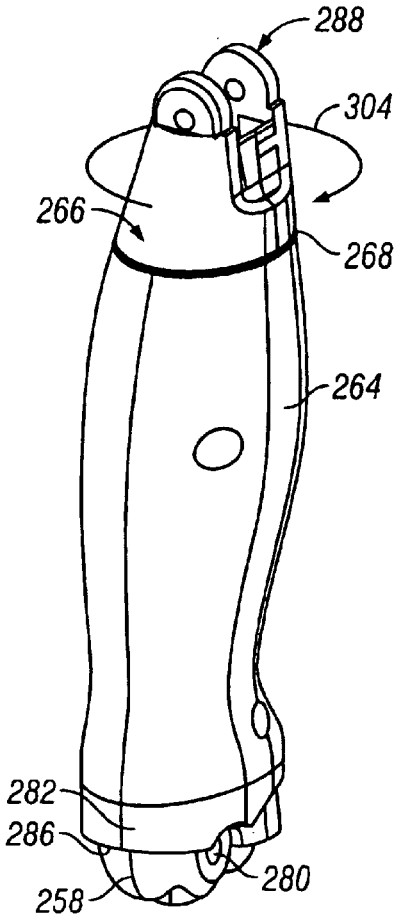
FIG. 10*a* is a perspective view of the upper leg and thigh section of one of the legs from the embodiment in FIG. 9*a;*
Figure 10B:
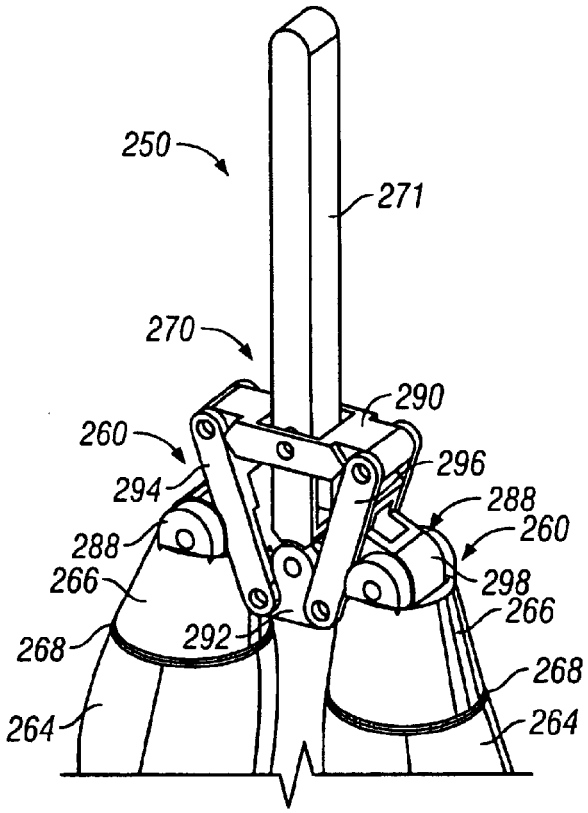
FIG. 10*b* is a perspective view of the hip mechanism and thigh sections of the embodiment in FIG. 9*a;*

Referring now to FIG. 10*a*, as mentioned above, the upper leg section 264 is attached to the thigh section 266, which is rotatably secured within the upper leg section 264 (shown in greater detail below in reference to FIG. 14). The thigh section 266 is further attached to the hip mechanism 270. The hip mechanism 270 (FIG. 10*b*) includes a pair of uneven substantially parallel horizontal sides 290 and 292 that are pivotally connected on their ends to a second pair of sides 294 and 296. Since the horizontal sides 290 and 292 are not identical in length, the second pair of sides is angled forming a pivotal trapezoid. Intersecting the pivotal trapezoid is an upper body mount 271, which permits the upper body to be attached to the hip mechanism 270. Each vertical side 294 and 296 further include a male hip mount 298 that is received by a female hip mount 288 defined in each thigh section 266, thereby allowing each leg 254 to be attached to the hip mechanism 270.

Figure 11:
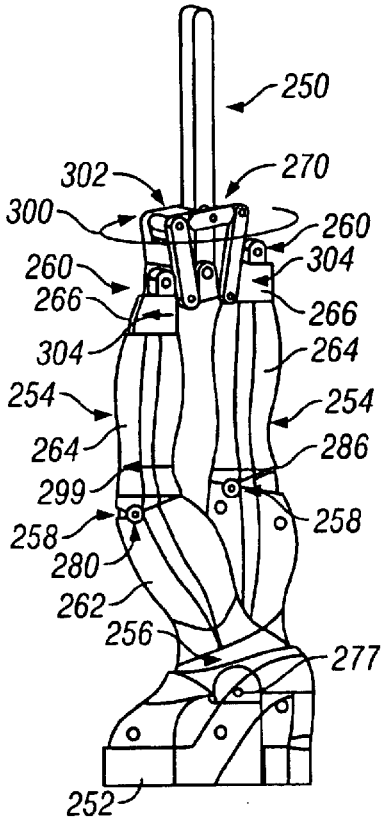
FIG. 11 is a side view of the embodiment in FIG. 9*a*, illustrating the movement in the upper leg section, thigh sections and hip mechanism in response to movement in one of the legs.
Figure 12:
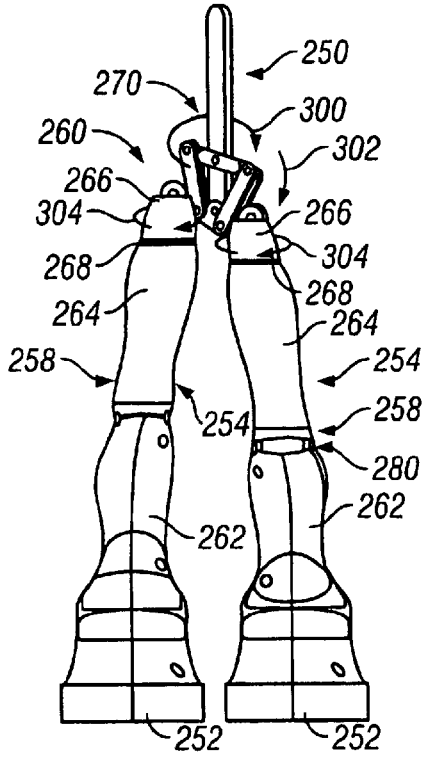
FIG. 12 is a rear view of the embodiment from FIG. 11.

Continuing to refer to FIGS. 9*a* through 12, as the lower leg section 262 pivots forwards about the ankle region 256 the upper leg section 264 will remain substantially vertical, since the upper portion 268 of the upper leg section 264 is not pivotally connected to a hip mechanism, such as illustrated in the previous embodiments. The upper leg section 264 will, however, move forwards (FIG. 11 indicated by arrow 299). As the upper leg section 264 moves forwards, the hip mechanism 270 rotates forwards about the opposite upper leg section 264 and flexes downwardly in response thereto (FIGS. 11 and 12 indicated by arrows 300 and 302 respectively). This in turn causes both the thigh sections 266 to rotate within the upper leg sections 264, indicated by arrows 304. In addition, the movement in the legs causes the torso to exhibit twisting motion about its center or about the upper body mount 271.

Figure 13:
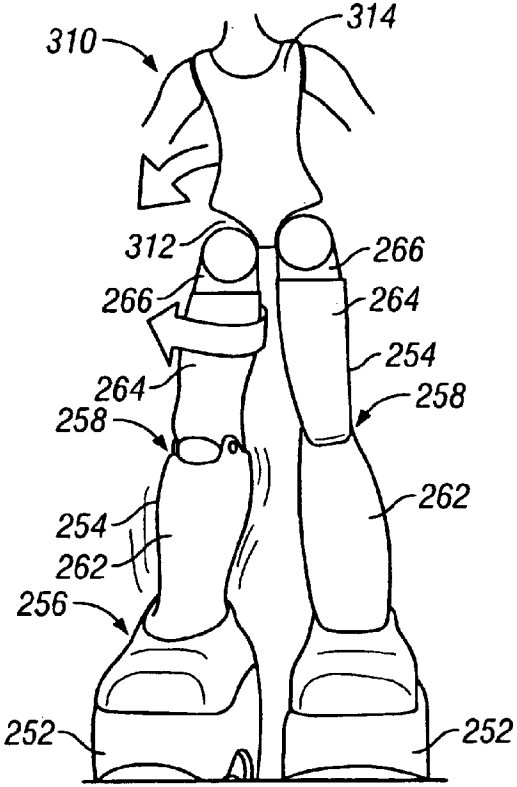
FIG. 13 is a front view of a figure that incorporates another hip mechanism in accordance with the present invention.
Figure 14:
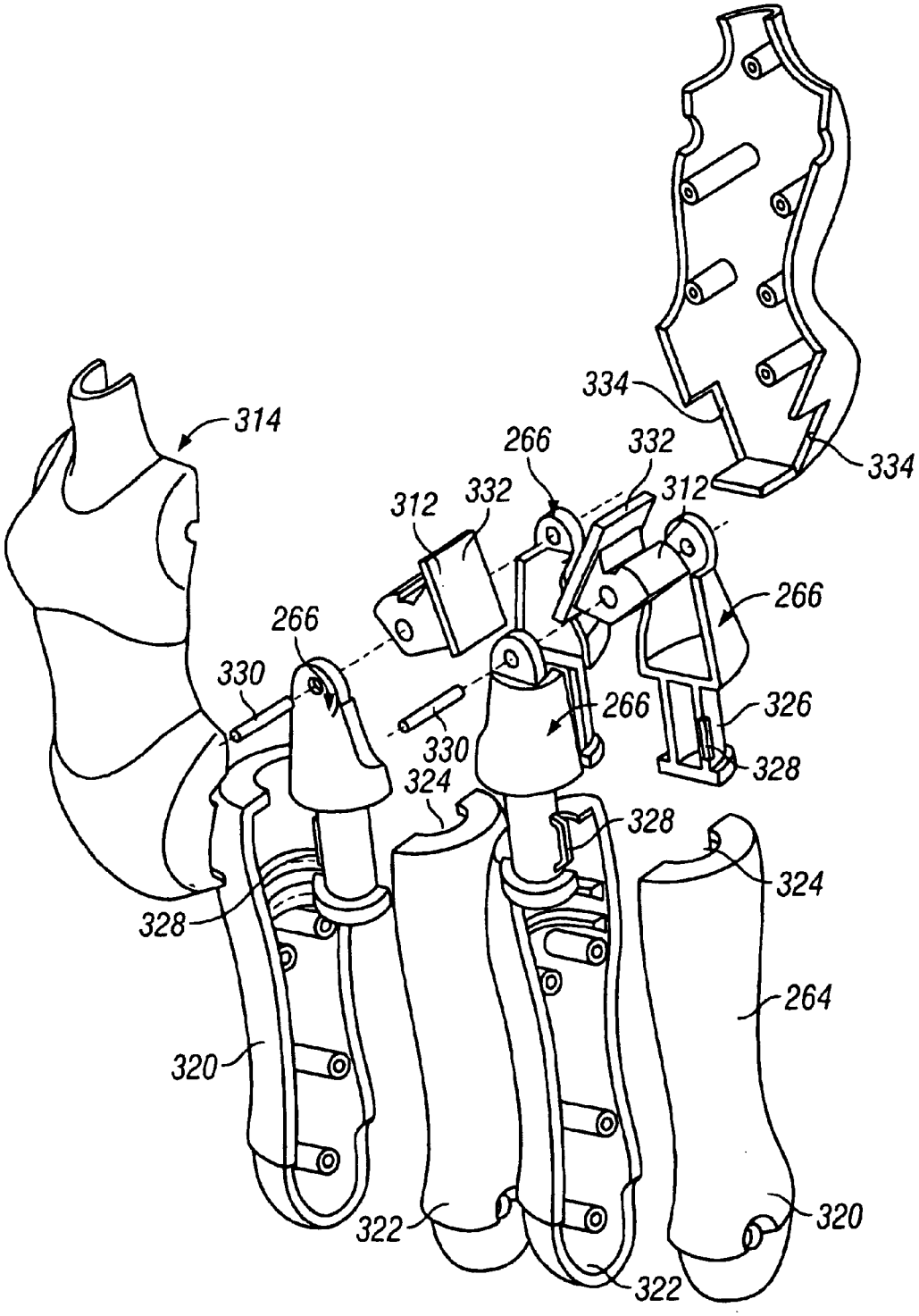
FIG. 14 is an exploded view of the upper leg section, hip joints and torso of the embodiment from FIG. 13.

Referring now to FIGS. 13 and 14, a FIG. 310 is partially illustrated and configured similarly to the previous embodiment of FIG. 250 in that the FIG. 310 includes legs 254 that are operatively controlled by feet mechanism (not shown). The legs 254 include lower leg sections 262 that are pivotally connected to each foot 252 and house lower leg links that pivot the lower leg sections 262 forwards and backwards. The lower leg sections 262 are further pivotally connected to upper leg sections 264 at the knee region 258 in a manner similar to the aforementioned FIG. 250. The legs 254 also include thigh sections 266 that are rotatably connected within the upper leg sections 264 and that are pivotally connected to a hip mechanism. However, in this embodiment the hip mechanism is defined by a pair of separate hip joints 312 that are secured within the torso 314.

Referring now to FIG. 14, the upper leg section 264 is preferably a two piece housing 320 and 322 that when assembled, forms an aperture 324 that is sized to receive the lower end 326 of the assembled thigh sections 266. The lower end 326 of the thigh sections further include projecting members 328 that act against stops (not shown) on the interior of the thigh sections 266 to prevent the thigh sections 266 from rotating or moving too far in any direction. The projecting members 328 also serve as female/male connections in order to assemble the two piece thigh sections 266. However, other means of assembling the two piece thigh sections 266 may be employed.

The upper end of the thigh sections 266 is pivotally attached to the hip joints 312 by a hip pin 330. The hip joints 312 include a slight taper and then expand at the end to a flange 332. The slight tapered section is received within openings 334 defined in the lower portion of the torso 314, such that the torso 314 may tilt about the tapered section to either side. The flanges 332 further secure the hip joints 312 to the torso 314 and prevent the torso 314 from tilting too much.

Figure 15:
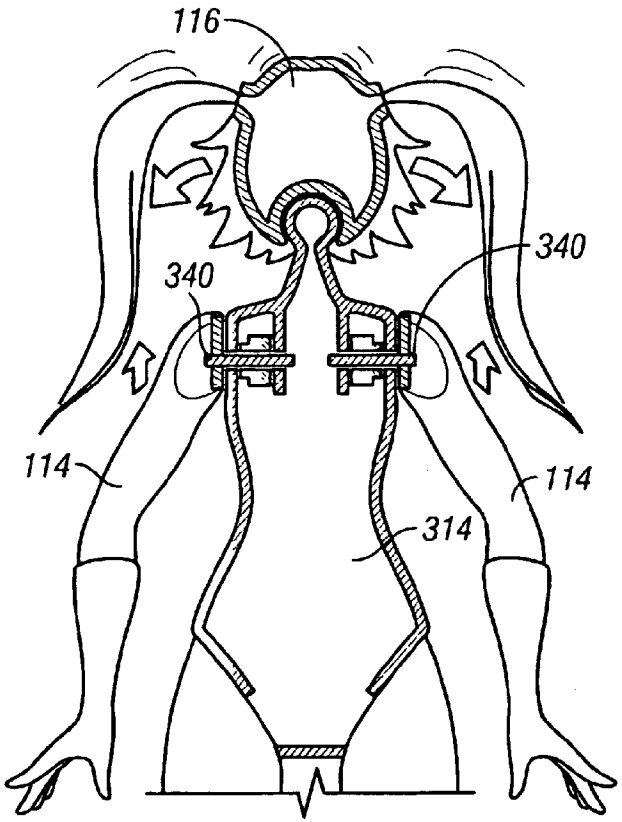
FIG. 15 is a front cross section view of the torso illustrating pivoting arms and head of the embodiment from FIG. 14.

Referring now to FIG. 15, the torso 314 is shown with freely pivoting arms 114 and head 116. When the lower body is moving or dancing, the arms 114 may pivot about an axle 340 that attaches the arms 114 to the torso 314. The head 116 may also be pivotally attached to the neck but may alternatively include the neck, which would then be pivotally attached to the torso 314.

It is also contemplated by the present invention that other hip mechanisms or joints may be included with the present invention that would permit the hip region to exhibit similar functions. For example, well known ball joint sockets would permit the legs to move and rotate with respect to the lower torso.

Figure 16:
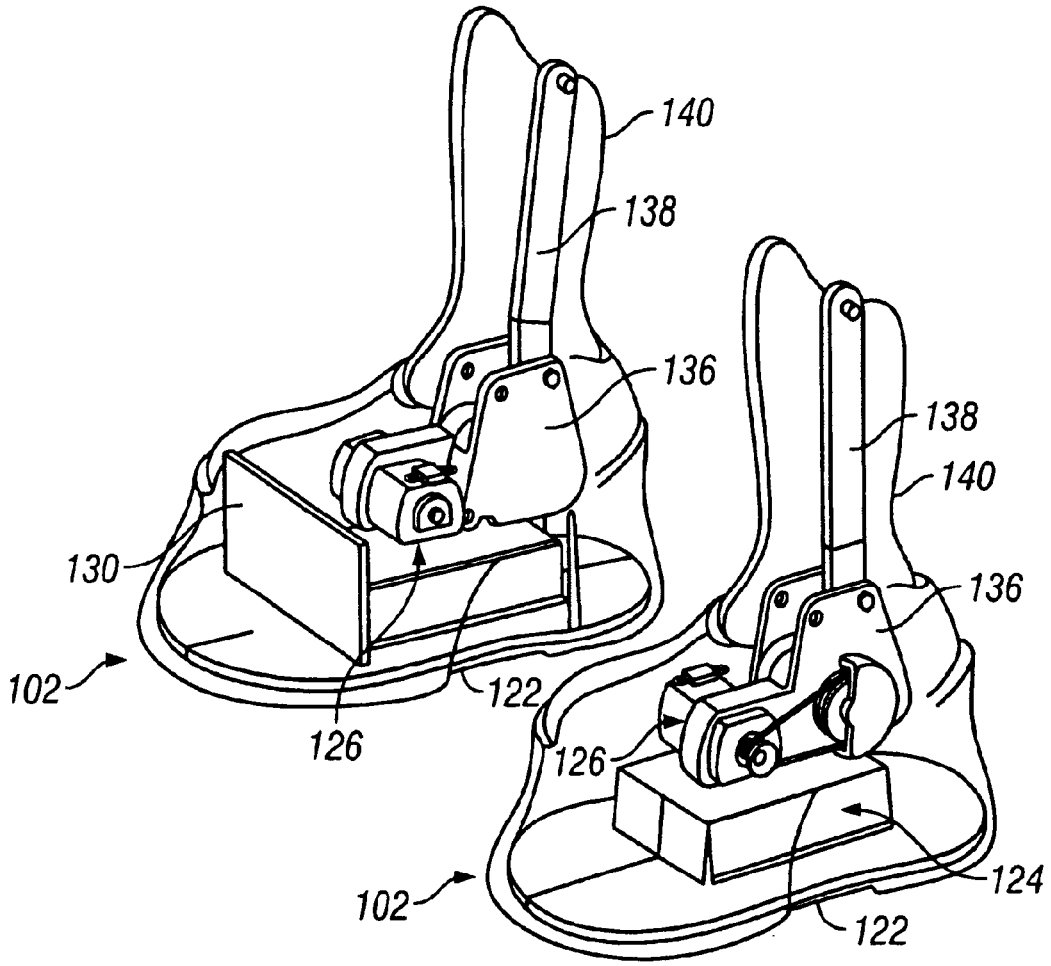
FIG. 16 is perspective view of another embodiment of the feet without wheels.

Referring now to FIG. 16, in yet another embodiment of the present invention, a figure may have feet 102 that do not include front or rear wheels. The bottom section 122, as mentioned above, would be substantially flat in order to keep the figure in a free-standing position. Even though the embodiment does not include wheels, the figure may still be capable of being controlled or programmed to move around. As mentioned above, the momentum of the pivoting legs will cause the feet to move or shuffle across the surface.

In addition, this embodiment does not include a foot communication link and only includes a single circuit board 130. As such the figure would include a means to communicate with both foot mechanisms 126. It should be further contemplated by the present invention, that the number or placement of circuit boards could be changed without diverging from the spirit and scope of the present invention. For example, other embodiments may include a single circuit board in the upper body of the figure.

Figure 17B:
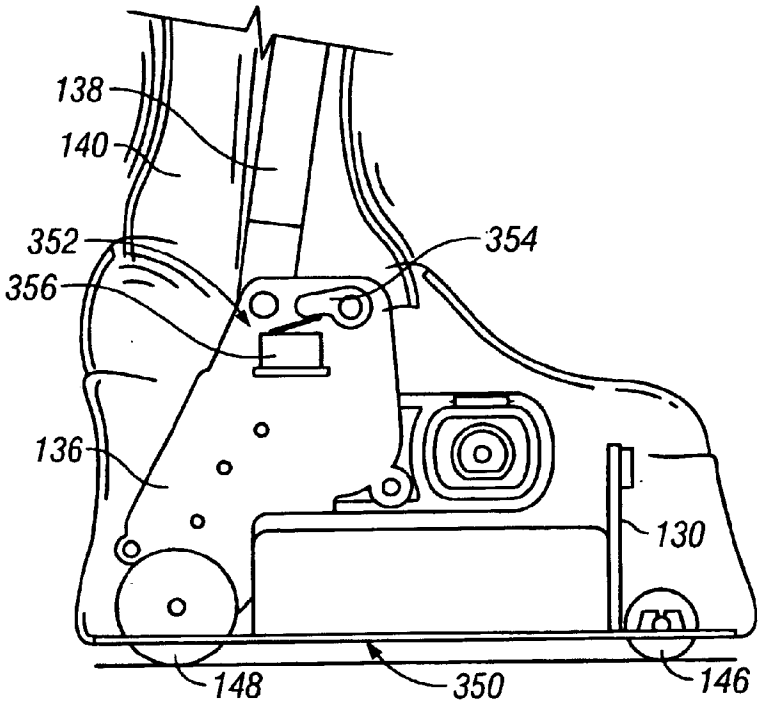
FIGS. 17*a* and 17*b* are side views of another embodiment of a foot with a position indicator means illustrating the foot when the leg is in a forward position and a backward position.
Figure 17A:
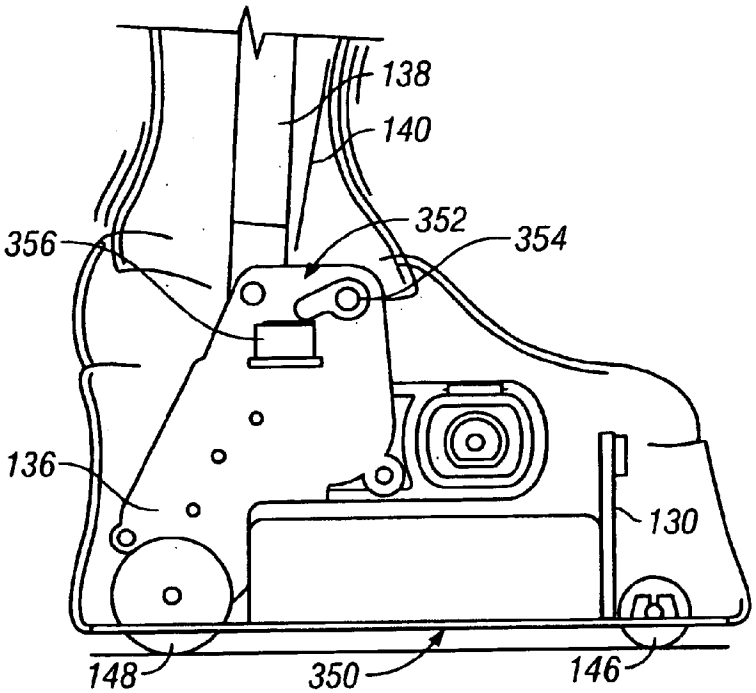

In addition thereto, in some aspects of the invention, it may become necessary to determine the position of each foot, i.e. whether it is forwards or backwards. Referring now to FIGS. 17*a* and 17*b*, a foot 350 is illustrated with a position indicator means 352. The position indicator means 352 is in communication with the circuit board 130, to ascertain the position of each leg and to transmit the position to the circuit board in order to adjust the speed or direction in which the leg or foot 350 is moving. The position indicator means 352 may be defined as having a direction tab 354 that activates a direction switch 356, which communicates to the circuit board 130 the position of the foot 350. When the lower leg link 138 is standing approximately in an upright position (FIG. 17*a*), the direction tab 354 activates the direction switch 356, communicating the position to the circuit board 130. However, when the lower leg link 138 is moved (FIG. 17*b*), the direction tab 354 deactivates the direction switch 356, which will indicate to the circuit board 130 that the lower leg link 138 has moved from the upright position. As such the circuit board 130 may properly control the foot mechanisms 126. While the embodiment illustrated in FIGS. 17*a* and 17*b* illustrates front and rear wheels 146 and 148, the other embodiments disclosed herein, which do not include wheels may also include a means to determine the position thereof.

Figure 18B:
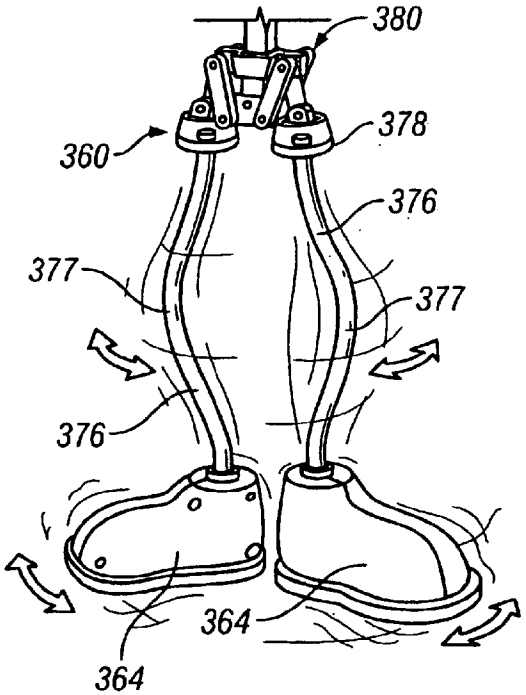
FIG. 18*b* is a front view of the lower body of the figure incorporating the feet from FIG. 18*a;*
Figure 18A:
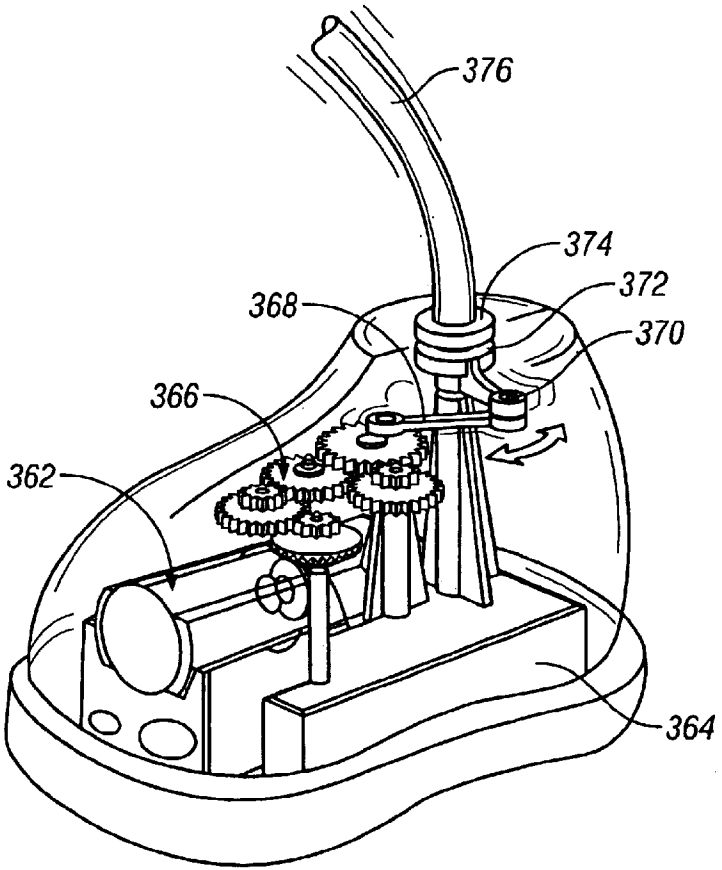
FIG. 18*a* is a perspective outlined view of another embodiment of a foot that includes a foot mechanism that twists the foot to the left and right.

In another embodiment of the present invention, illustrated in FIGS. 18*a* and 18*b*, a FIG. 360 incorporates a foot mechanism 362 that causes the feet 364 to independently twist to the left and right. The foot mechanism 362 drives a gear train 366 that is connected to a crank arm 368 that moves a leg crank 370 back and forth. The leg crank 370 is connected to an ankle plate 372 that is pivotally attached to the foot 364. The torque of the foot mechanism 362 moving the leg crank 370 back and forth causes the foot to twist in a side-to-side motion.

In addition the ankle plate 372 may further be connected to a lower leg plate 374 that is attached to a leg 376. The leg 376 is further attached to an upper plate 378 that is secured to a hip mechanism 380, such as one of the hip mechanisms disclosed herein. The torque of the foot mechanism 362 will further cause the legs 376 to oscillate or wobble in opposite directions of the feet enhancing the dancing effects. In addition the legs 376 may include knee bends 377 to increase the life-like appearance of the animated movements. As opposed to other prior art figures, the present embodiment includes the mechanisms in the feet to provide greater stability, which permits the mechanisms to operate at a greater speed.

Figure 19A:
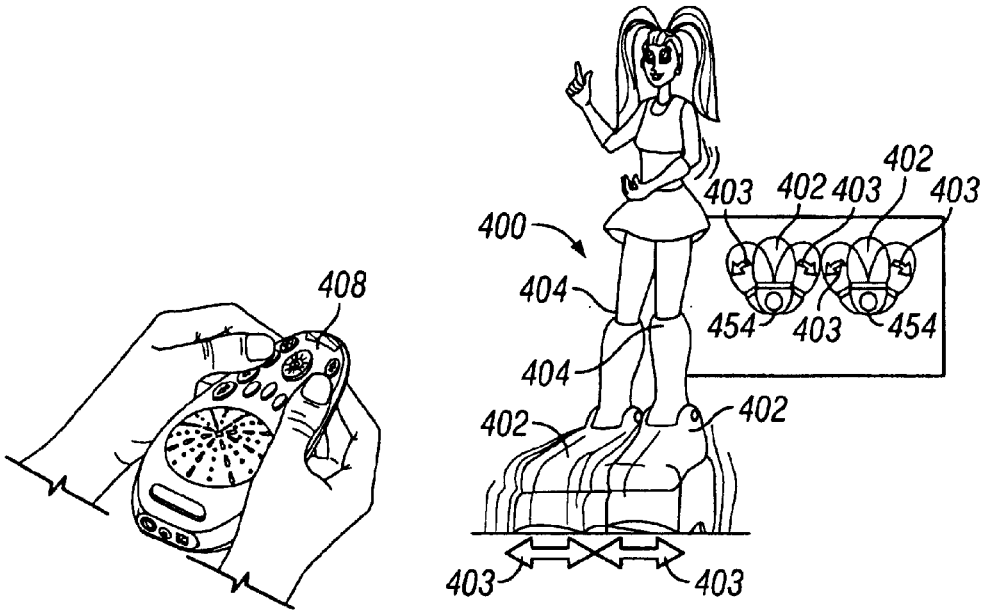
FIG. 19*a* is a perspective view of another embodiment of the present invention incorporating feet mechanisms that independently twist the feet left and right illustrated herein and bend the legs forwards and backwards.
Figure 19B:
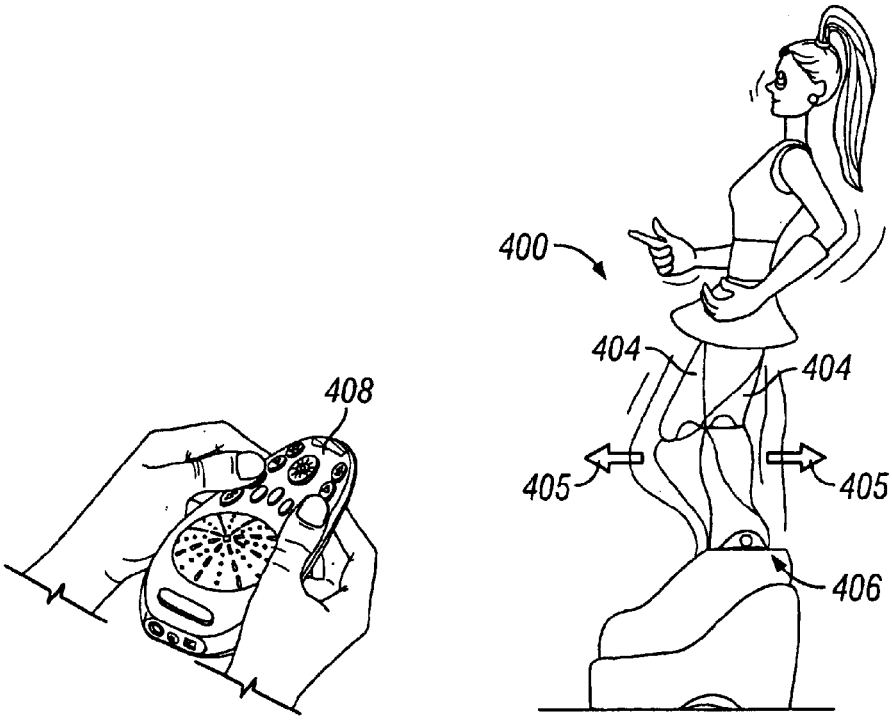
FIG. 19*b* is a side view of the figure from FIG. 19*a* illustrating one of the legs bending.
Figure 20A:
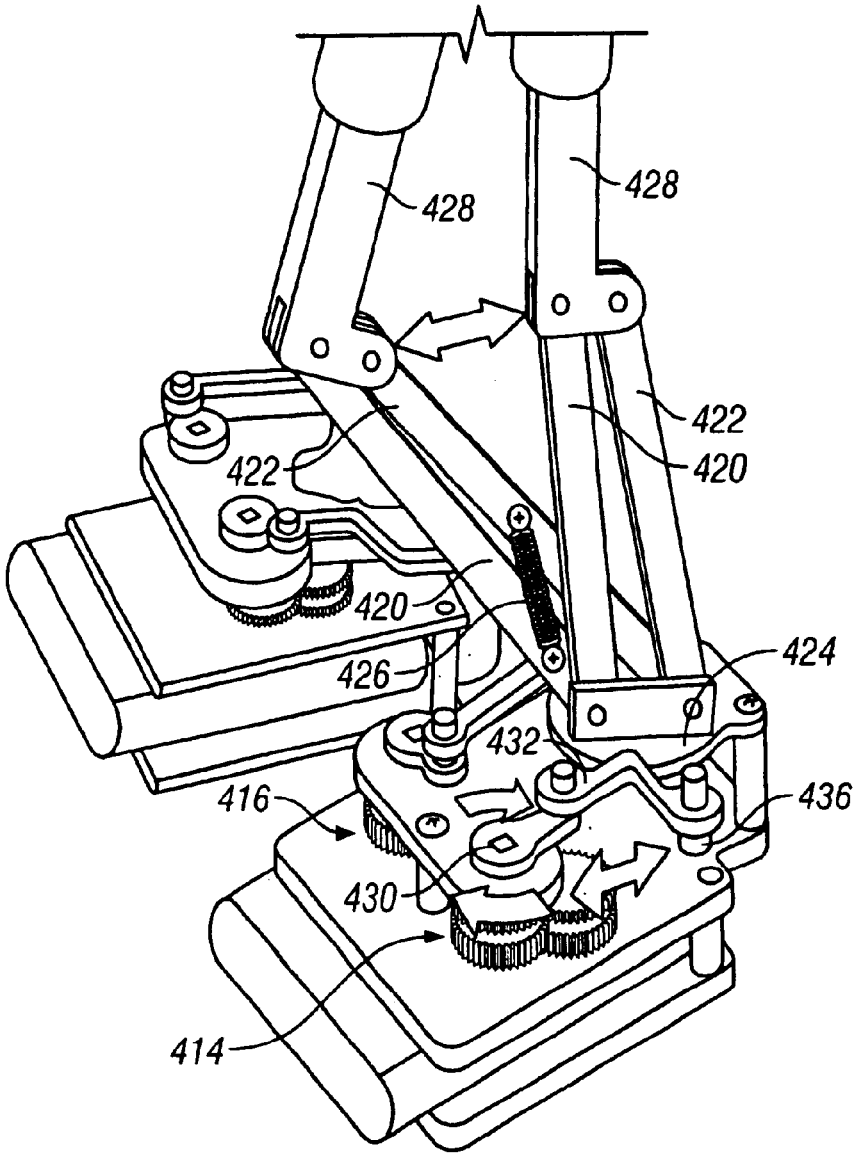
FIG. 20*a* is a perspective view of the lower leg section and foot mechanism when the motor is operating in reverse to pivot the legs forwards and backwards.
Figure 20B:
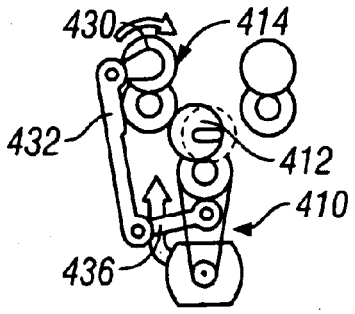
FIG. 20*b* is a top view of the foot mechanism engaging the leg pivot gear train when the motor is operator in reverse.
Figures 21A, 21B:
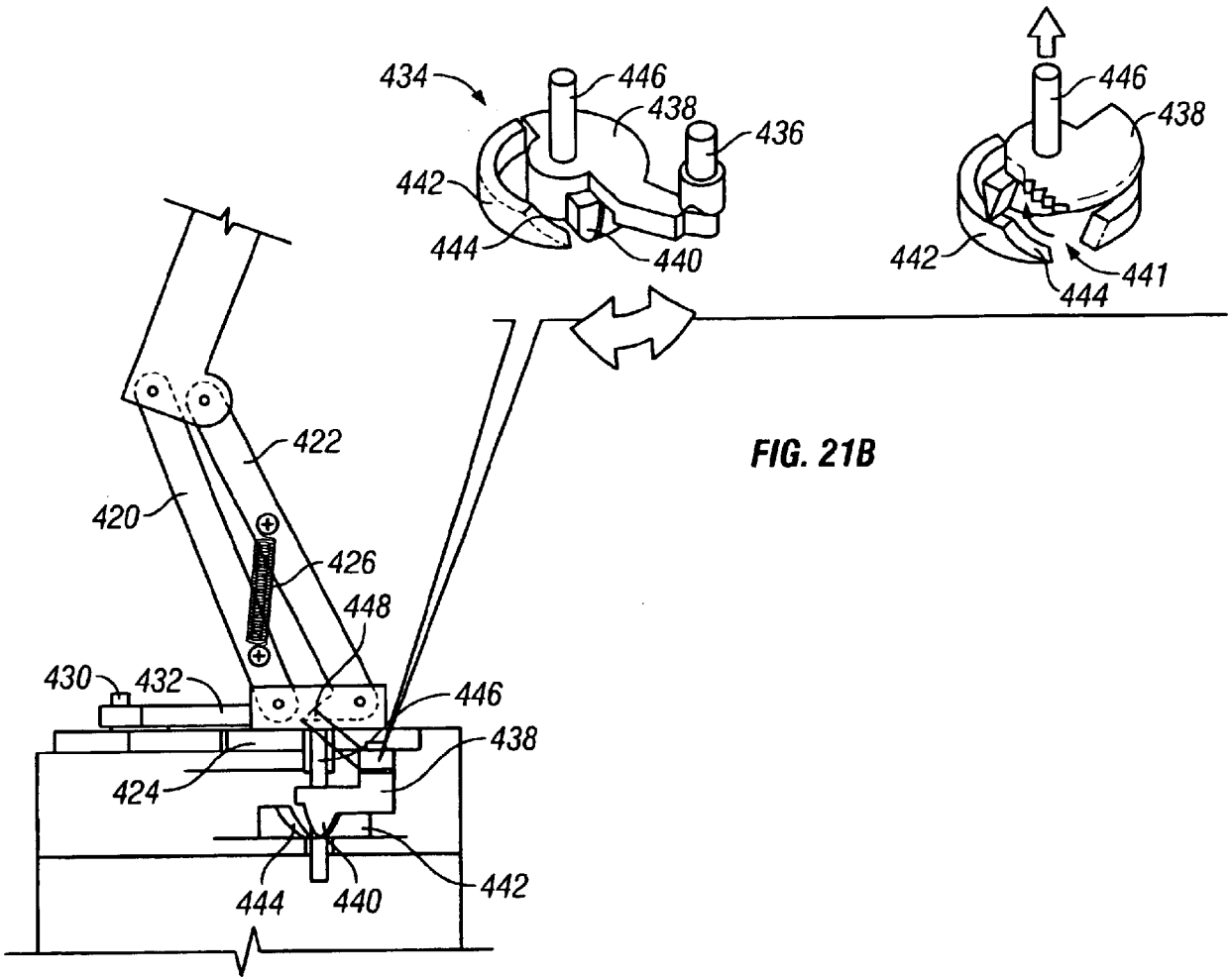
FIG. 21*a* is a side view of the lower leg section and foot mechanism when the motor is operating in reverse and the leg pivot mechanism is not acting on the leg links.
FIG. 21*b* is a perspective view of the leg pivot mechanism.
Figure 21C:
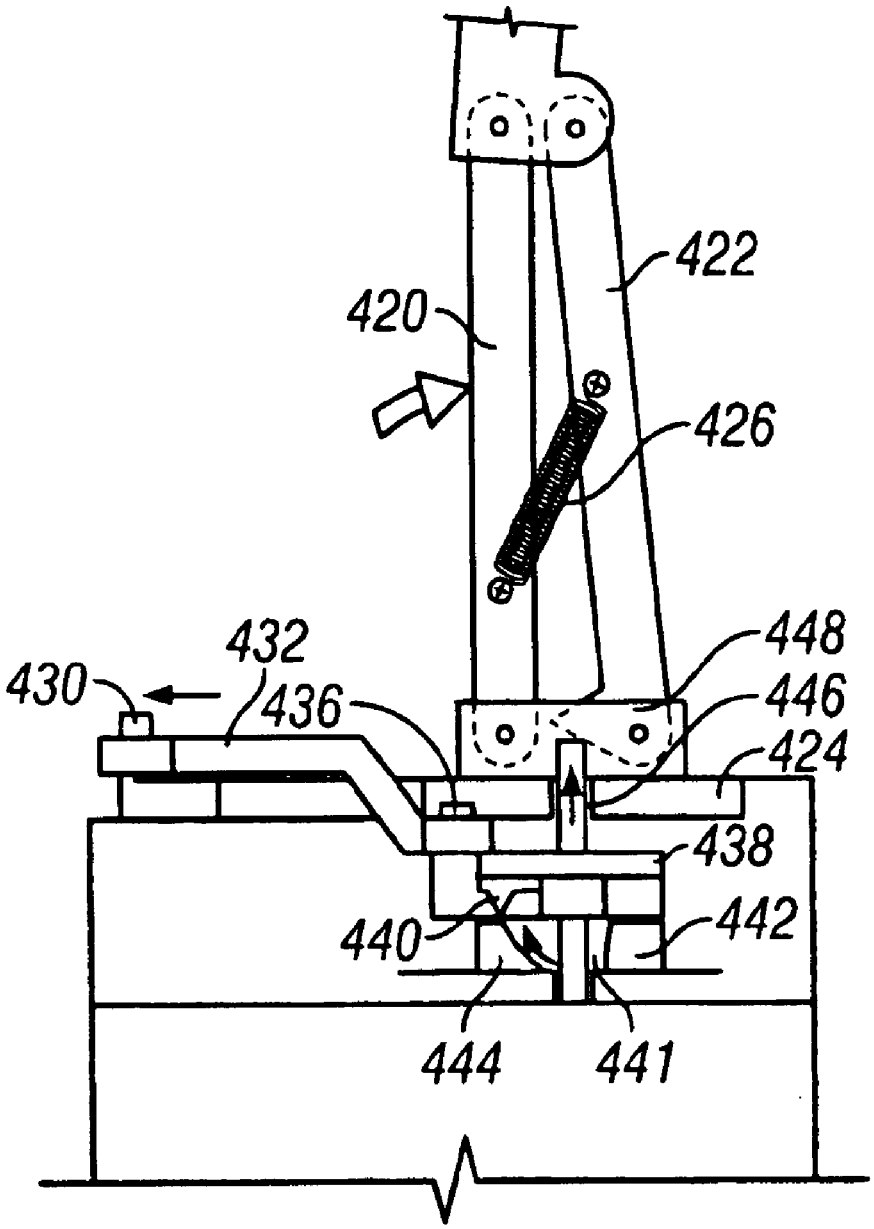
FIG. 21*c* is a side view of the lower leg section and foot mechanism when the motor is operating in reverse and the leg pivot mechanism is acting upon the lower leg links.
Figure 22A:
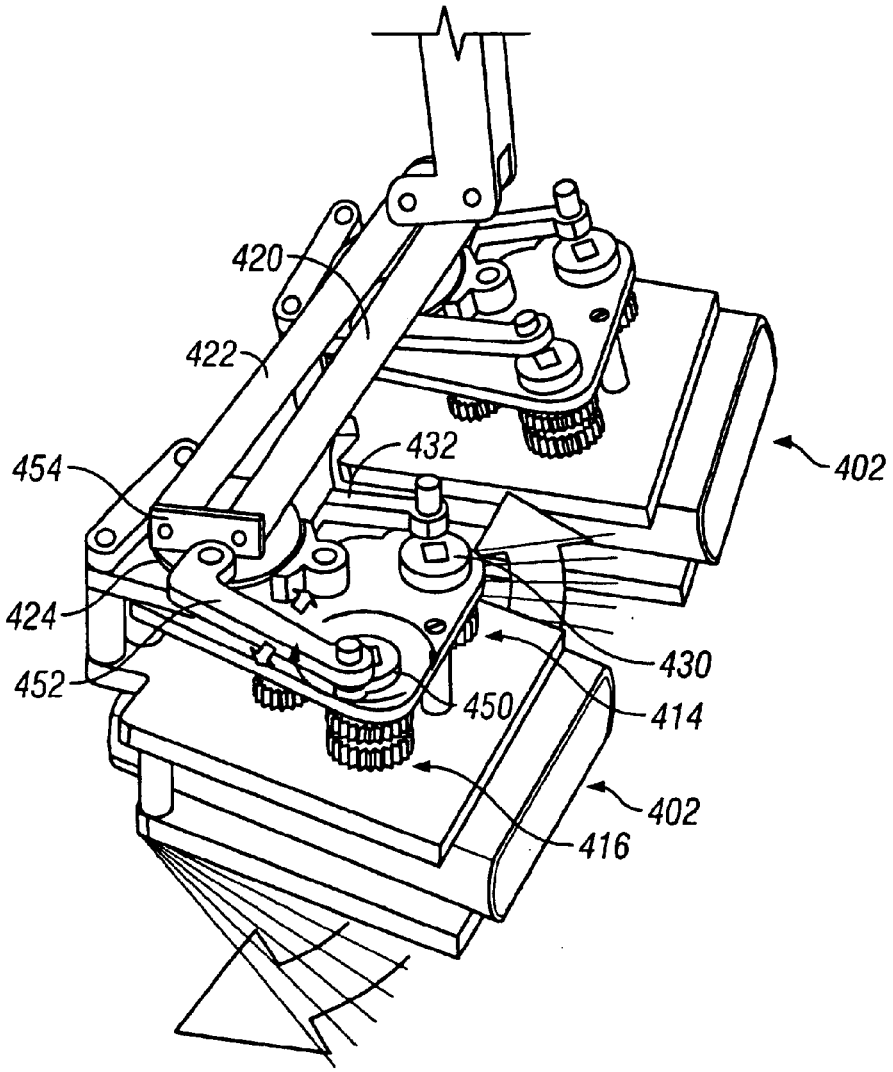
FIG. 22*a* is a perspective view of the lower leg section and foot mechanism when the motor is operating forwards to engage the twisting gear train in order to twist the feet side-to-side.
Figure 22B:
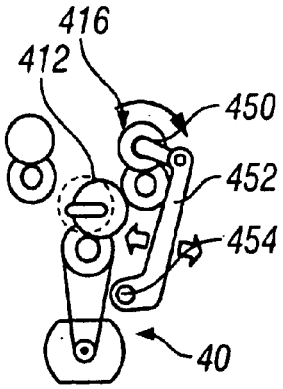
FIG. 22*b* is a top view of the foot mechanism engaging the twisting gear train when the motor is operator in the forward direction.

In another embodiment of the present invention, illustrated in FIGS. 19–21, a FIG. 400 incorporates a foot mechanism 410 (FIGS. 20–21) that causes the feet 402 to independently twist (FIG. 19*a* indicated by arrows 403) and causes the legs 404 to pivot forwards and backwards (FIG. 19*b* indicated by arrows 405) about the ankle region 406. As illustrated the FIG. 400 may be controlled through a remote control unit 408. Each leg 404 includes a foot mechanism 410 that drives a slider gear 412 that engages either a leg pivot gear train 414, when the foot mechanism is operating in a reverse direction (FIG. 20*b*), or engages a twisting gear train 416, when the foot mechanism 410 is operating in a forward direction (FIG. 22*b*).

Referring first to FIGS. 20*a* and 20*b*, each leg includes a pair of lower leg links (a front leg link 420 and a rear leg link 422) that are connected at one end to an ankle plate 424, which is secured within the foot 402. A leg link spring 426 further connects the leg links together, explained in greater detail below. The other ends of the lower leg links 420 and 422 are pivotally connected to an upper leg link 428 or upper leg section, either of which would not limit the present embodiment.

When the foot mechanism 410 is operating in reverse, the slider gear 412 engages the leg pivot gear train 414, which begins to rotate a first cam 430. The first cam 430 is connected to a first connecting rod 432, which moves a lever 436 that is defined in a leg pivot mechanism 434 (FIG. 21*b*) forwards and backwards. The leg pivot mechanism 434 causes the pair of lower leg links 420 and 422 to pivot forwards and backwards about the ankle region, defined by the pivotal connection between the lower leg links and the ankle plate 424.

The leg pivot mechanism 434 includes a pair of sliding plates. The top plate 438 includes a downwardly projecting edge 440 that is received in a channel 441 defined in the lower plate 442. The channel 441 includes a ramp 444 such that when the top plate 438 slides on top of the lower plate 442, the downwardly projecting edge 440 travels up the ramp 444 raising the top plate 438. The top plate 438 includes a centered positioned upwardly projecting pin 446 that moves through an opening in the ankle plate 424 in order to engage a flange 448 on the rear leg link 422, when the top plate 438 moves upwardly along the ramp 444. The pin 446 pivots the rear leg link 422 backwards causes the leg 404 to stand substantially upright (FIG. 21*c*). As the first cam 430 continues to rotate, the first connecting rod 432 moves the lever 436 backwards rotating the projecting edge 440 back down the ramp, lowering the pin 446. At this point, the leg link spring 426 compresses the two leg links 420 and 422 together, causing the leg links to pivot forwards (FIG. 21*a*).

When the foot mechanism 410 is operating forwards, the slider gear 412 engages the twisting gear train 416 (FIGS. 22*a* and 22*b*), which rotates a second cam 450. The second cam 450 is attached to a second connecting rod 452 that is pivotally secured to the ankle plate 424 by a pivot pin 454. When the second cam 450 rotates, the second connecting rod 452 moves from side-to-side creating a torque that causes the foot 402 to twist to either side. In addition, the legs 404 will twist in the opposite direction in response to the torque.

In yet another embodiment of the present invention, the dancing figure may include a "try me" feature for point of sale demonstration or sampling. When the dancing figure and remote control unit are provided in a point of sale package, a user may desire to view the figure operating in a limited or full mode. Since the remote control unit may not be positioned to remotely operate the dancing figure or may interfere with other remotely operated toys, a novel "try me" feature must be provided. A try me button or switch may be placed in one of the oversized feet or elsewhere on the dancing figure, which when pressed activates a pre-recorded animation sequence. In such instances the dancing figure would be pre-packaged with a power source. The dancing figure may also include a pre-recorded music or audio sounds to be replayed when the try me button is activated.

If the remote control unit contains the speaker then the pre-recorded music is sent through a tether that is attached between the dancing figurine and the remote control unit. The tether is in communication with the try me button and the speaker, such that the pre-recorded music is emitted through the speaker in the remote control unit. Because of costs associated with also pre-providing a power source on the remote control unit, the remote control unit could draw power, if necessary, power source on the dancing figure in order to operate during this "try me" playback mode. Such power could be transferred to the remote control unit via the tether. In addition, the power transfer could be used to activate limited features on the remote control unit such various lights or other displays. Moreover, upon opening the package and removing the tether in order to operate the dancing figure in its full capacity, the try me button may further become deactivated such that the try me button would no longer function and may further activate the normal features of the dancing figure.

Figure 23:
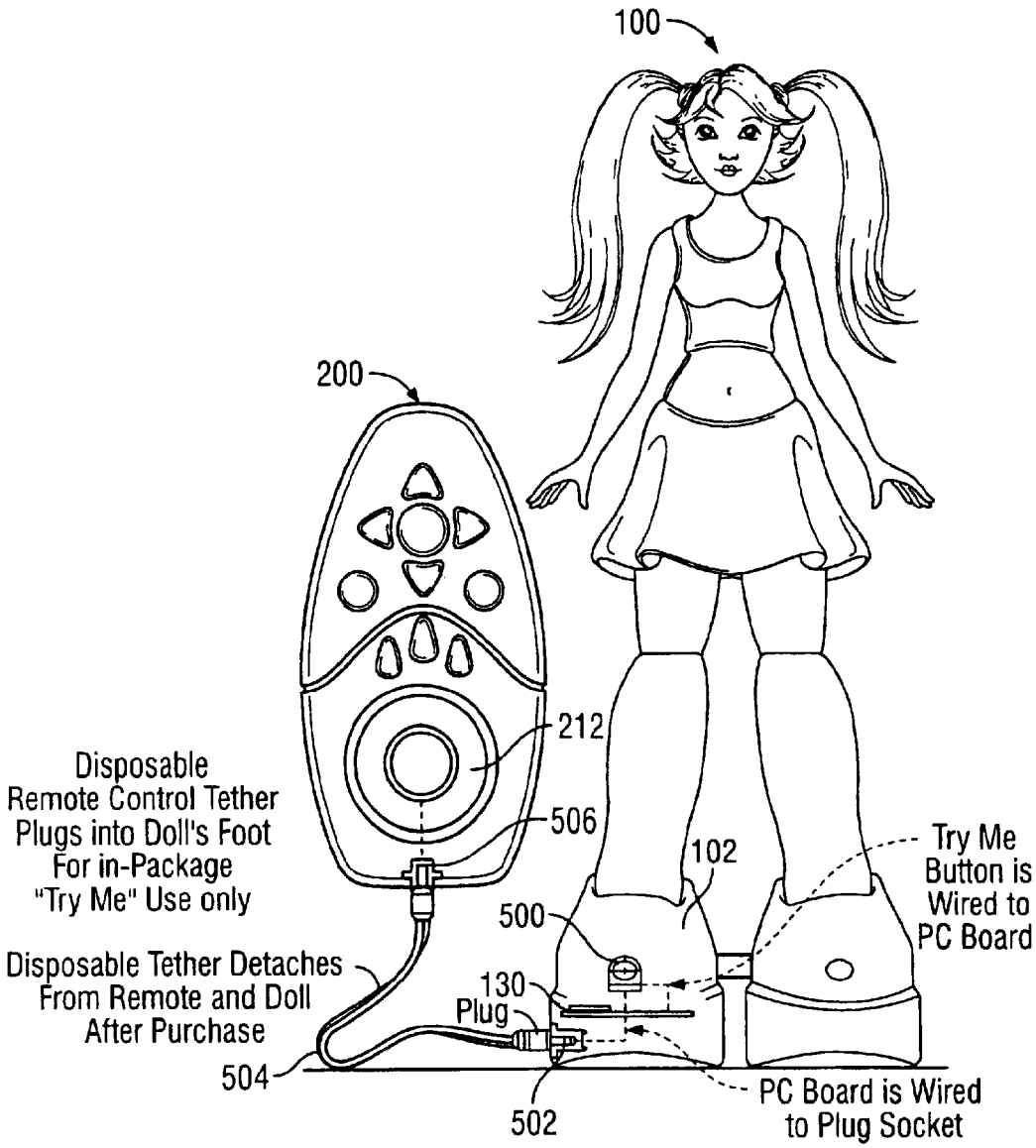
FIG. 23 is a front perspective view of the doll tethered to the remote control unit and illustrating the internal communication means necessary for operation of a "Try Me" feature.

Referring now to FIG. 23, the FIG. 100 includes a "try me button" or button 500 on one of the figure's feet 102. The button 500 is in communication with the PC Board 130, such as through wires. The PC Board is further in communication with an adaptor 502 that is sized to receive one end of the tether 504. The other end of the tether 504 is received into an adaptor 506 on the remote control unit 200. The adaptor 506 is in communication with the speaker 212 via wires. As previously mentioned, the tether 504 is removable from the FIG. 100 and the remote control unit 200. However, while inserted, the tether 504 permits both power and sounds to be transferred from the FIG. 100 to the remote control unit 200. This provides for a novel "Try Me Feature" that is available when the figure is packaged for retail. To operate the Try Me Feature, the tether 504 is first inserted into the adaptors 502 and 506. The user then presses the button 500 which causes the circuit board to activate one of the dancing or moving features of the FIG. 100 and sends or transfers power and pre-programmed music to the remote control unit. The remote control unit having a speaker is then capable of emitting the music.

From the forgoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred. It is, of course, intended to cover by the appended claims all such modifications as fall within the scope of the claims.

We claim:

1. In the combination comprising an animated figure and a remote control, the animated figure having at least one pre-programmed animation sequence, at least one pre-recorded audio sequence and at least one control button for the activation of said at least one pre-programmed animation sequence and at least one pre-recorded audio sequence, and the remote control unit having a speaker, the improvement comprising a removable tether that when connected to the animated figure and the remote control unit, the removable tether is in communication with the at least one control button in the animated figure and the speaker in the remote control unit, such that when the control button is pressed the at least one pre-programmed animation sequence is activated through the animated figure and the at least one pre-recorded audio sequence is emitted through the speaker on the remote control unit.

2. The combination according to claim 1, wherein the removable tether is capable of transferring power from the animated figure to power the speaker on the remote control unit.

3. In the combination comprising a remotely controlled device and a remote control therefore, the remotely controlled device having a pre-programmed controllable feature, a pre-recorded audio sound, and a manual control button for the activation of said pre-programmed controllable feature and for the playback of said pre-recorded audio sound, and the remote control having a speaker, the improvement comprising:

a removable tether connected to said remotely controlled device and said remote control, the removable tether is capable of transferring power from said remotely controlled device to said remote control when the manual control button is pressed such that the speaker on the remote control is functional and the removable tether is further capable of transferring the pre-recorded audio sound from said remotely controlled device to said remote control such that the speaker emits the pre-recorded audio sound.

4. In the combination comprising a remotely controlled device and a remote control therefore, the remotely controlled device storing a pre-recorded audio sound, and having a control button, and the remote control having a speaker, the improvement comprising:

a removable link connected between the remotely controlled device and the remote control, the remotely controlled device being operable to emit the pre-recorded audio sound through the speaker on the remote control using the removable link when the control button is pressed.

5. The combination according to claim 4, wherein the remotely controlled device has a controllable feature and the controllable feature being operable by the control button.

* * * * *